US007004344B2

(12) United States Patent
Fulton et al.

(10) Patent No.: US 7,004,344 B2
(45) Date of Patent: Feb. 28, 2006

(54) COLLAPSIBLE BIN

(75) Inventors: Michael Wayne Fulton, Balzac (CA); Darrell Robert Paxton Weatherill, Kelowna (CA)

(73) Assignee: Tolko Industries Ltd., British Columbia (CA)

( * ) Notice: Subject to any disclaimer, the term of this patent is extended or adjusted under 35 U.S.C. 154(b) by 505 days.

(21) Appl. No.: 10/344,687

(22) PCT Filed: Aug. 20, 2001

(86) PCT No.: PCT/CA01/01185

§ 371 (c)(1),
(2), (4) Date: Feb. 21, 2003

(87) PCT Pub. No.: WO02/18217

PCT Pub. Date: Mar. 7, 2002

(65) Prior Publication Data

US 2003/0222080 A1 Dec. 4, 2003

Related U.S. Application Data

(60) Provisional application No. 60/229,180, filed on Aug. 29, 2000.

(51) Int. Cl.
*B65D 6/26* (2006.01)

(52) U.S. Cl. ..... 220/4.31; 220/324

(58) Field of Classification Search ..... 220/4.28, 220/4.31, 345.2; 206/600; 217/12 R, 13, 217/62
See application file for complete search history.

(56) References Cited

U.S. PATENT DOCUMENTS

| | | | | |
|---|---|---|---|---|
| 4,809,851 A * | 3/1989 | Oestreich et al. | ..... | 206/599 |
| 5,261,550 A | 11/1993 | Karpisek | ..... | 220/4.33 |
| 5,597,084 A | 1/1997 | Parasin | ..... | 220/4.28 |
| 6,073,768 A | 6/2000 | McCord et al. | ..... | 206/408 |

FOREIGN PATENT DOCUMENTS

| | | |
|---|---|---|
| AU | 284745 | 9/1963 |
| EP | 0727359 | 2/1996 |
| WO | 9515308 | 11/1995 |

* cited by examiner

*Primary Examiner*—Stephen Castellano
(74) *Attorney, Agent, or Firm*—Shlesinger, Arkwright & Garvey LLP

(57) ABSTRACT

A collapsible bin includes a lid and a box. The lid defines a lid plane and includes a flange extending in a plane parallel to the lid plane, the flange including an opening. The box includes a wall a channel with a flange contact surface and a bolt moveable in a direction perpendicular to the lid plane between securing and non-securing positions. When the bolt is in the securing position and the lid is positioned with the flange in the channel the bolt is positioned in the opening to restrict movement of the lid in a direction parallel to the lid plane and the flange engages the flange contact surface upon pressure on the lid in a direction away from the wall. A plurality of lid securing members releasably secure the lid to the wall.

30 Claims, 37 Drawing Sheets

COLLAPSIBLE BIN

This application claims priority from U.S. provisional application No. 60/229,180 filed Aug. 29, 2000 entitled COLLAPSIBLE BIN.

BACKGROUND OF THE INVENTION

Field of the Invention

This invention relates to collapsible shipping and storage bins, and more specifically to improvements to collapsible shipping and storage bins making them less susceptible to breakage and lid separation.

SUMMARY OF THE INVENTION

In one embodiment of the invention a collapsible container includes a lid and a box. The lid includes a pair of side edges connected to rear and front edges and a flange connected to the lid adjacent the front edge, the flange extending in a plane parallel with a lid plane defined by the lid, the flange including an opening therein. The box includes a front wall and a plurality of side walls which when joined together form an assembled box with a cavity between the walls, a channel in a first region of the front wall having a flange contact surface, a bolt moveable in a direction perpendicular to the lid plane between a securing position and a non-securing position. When the bolt is in the securing position and the lid is positioned in a first position adjacent the walls covering the cavity with the flange is positioned in the channel, the bolt is positioned in the opening to restrict movement of the lid in a direction parallel to the lid plane and the flange engages the flange contact surface upon pressure on the lid in a first direction away from the cavity to restrict movement of the lid in the first direction. A plurality of lid securing members are also provided releasably securing the side and rear edges to adjacent side walls.

In another embodiment of the invention the flange comprises a connection portion for connecting the flange to the lid attached to an extension portion extending in a plane parallel with the lid plane, the extension portion includes the opening therein, the extension portion extends into the channel when the lid is positioned adjacent the walls in alignment with the bolt to enable the bolt to extend through the opening when the bold is in the securing position.

In a further embodiment a lateral joining portion extends between the connection portion and extension portion to join those portions together, the joining portions extending generally perpendicular to the lid plane thereby positioning the extension portion in spaced paralleled alignment with the lid plane.

In another embodiment the front wall includes a reinforcement section positioned between the top edge of the front wall and the channel and wherein the flange contact surface is connected to the reinforcement section.

In yet another embodiment the lid includes a stop positioned to align the lid with respect to the box in the first position and to align the opening with the longitudinal axis of the bolt to permit the bolt to be moved into the opening when the bolt is moved to the securing position.

In another embodiment the plurality of lid securing members comprise a plurality of lid contact members connected to side edges and rear edges of the lid and a plurality of box securing members connected to the plurality of side walls and wherein the lid contact members and box securing members are engaged with one another when the lid is in the first position and not engaged with one another when the lid is in the second position.

In another embodiment the lid is moveable with respect to the box in the direction of the lid plane toward the front edge to move between a second position where the lid may be separated from the box and the first position wherein the lid securing members secure the side and rear edges to adjacent side walls and the flange is positioned in the channel.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 13C:
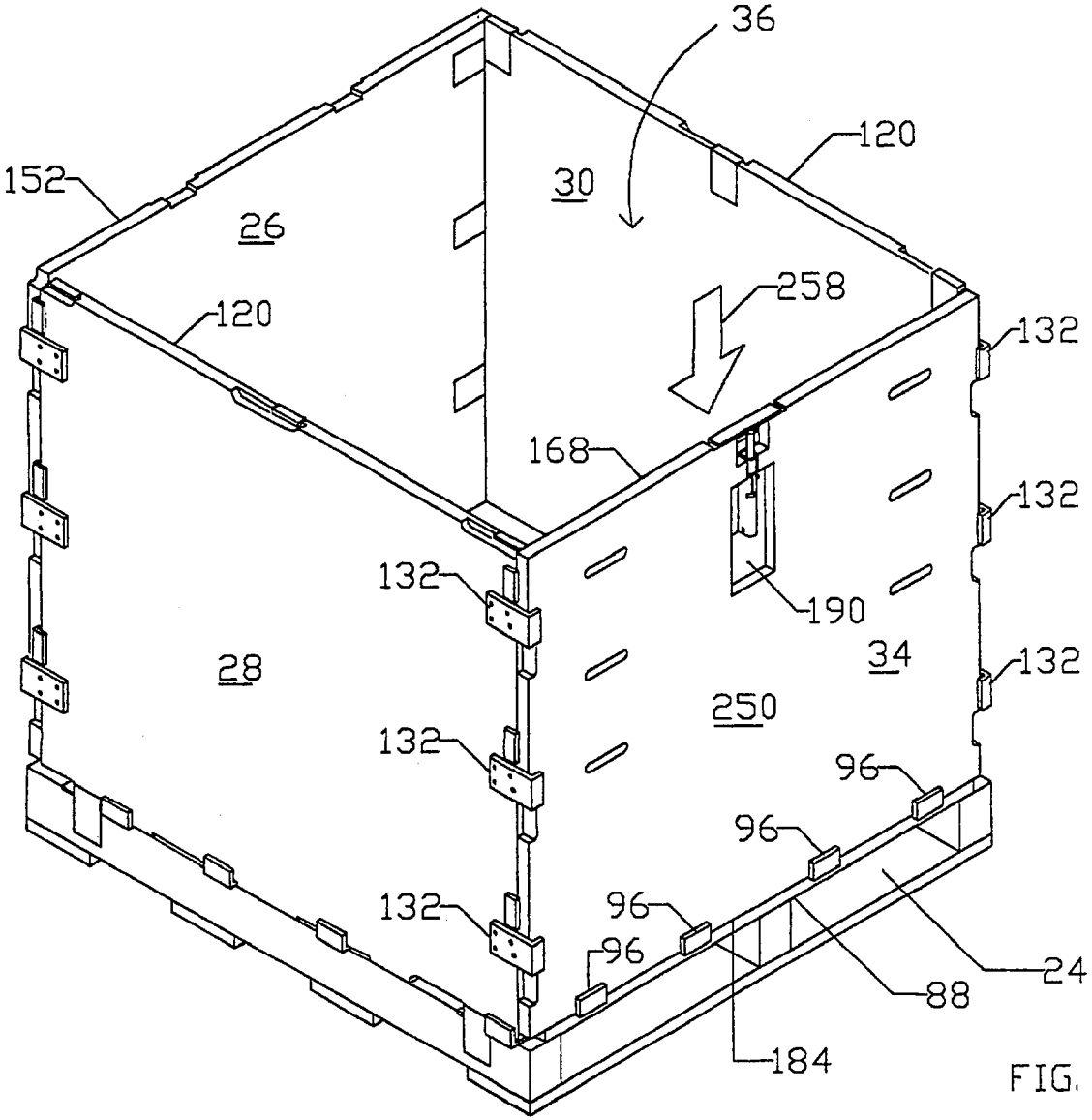
FIG. 13*c* is a perspective view of the left side, right side and rear side walls and front wall and base of the container.
Figure 14A:
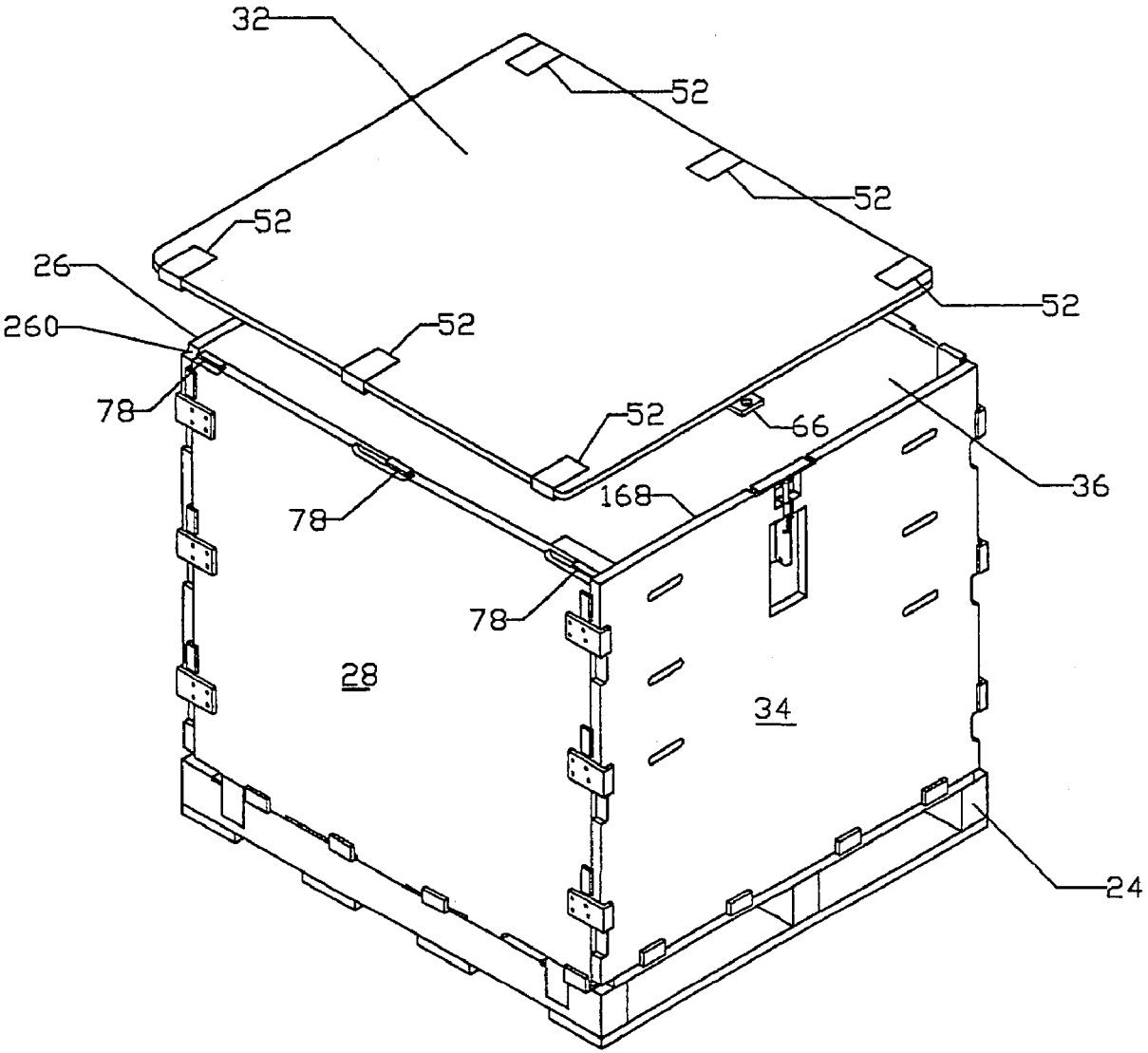
FIG. 14*a* is a perspective view of the container, with the assembled box and lid of the container.
Figure 14C:
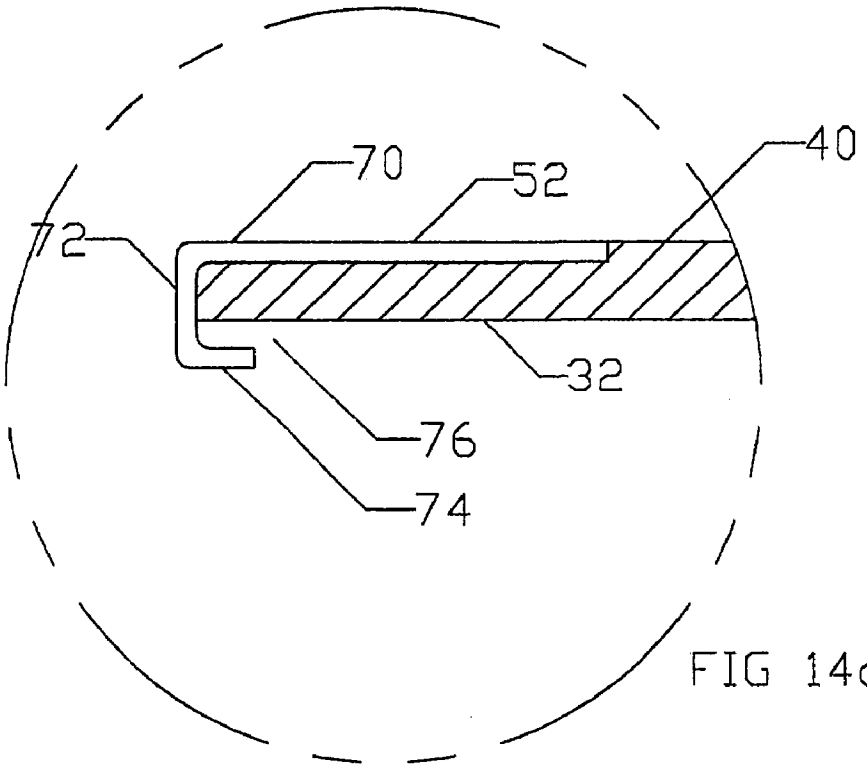
FIG. 14*c* is a section view taken along line 14*c*—14*c* of FIG. 14*b;*
Figure 14B:
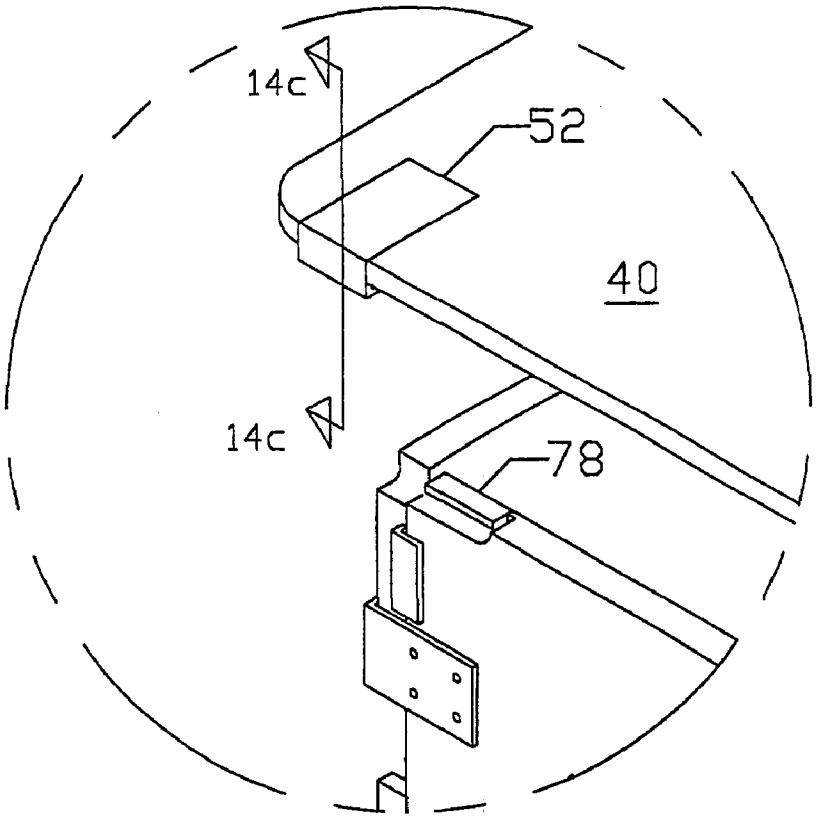
FIG. 14*b* is a detailed view of FIG. 14*a;*
Figure 14D:
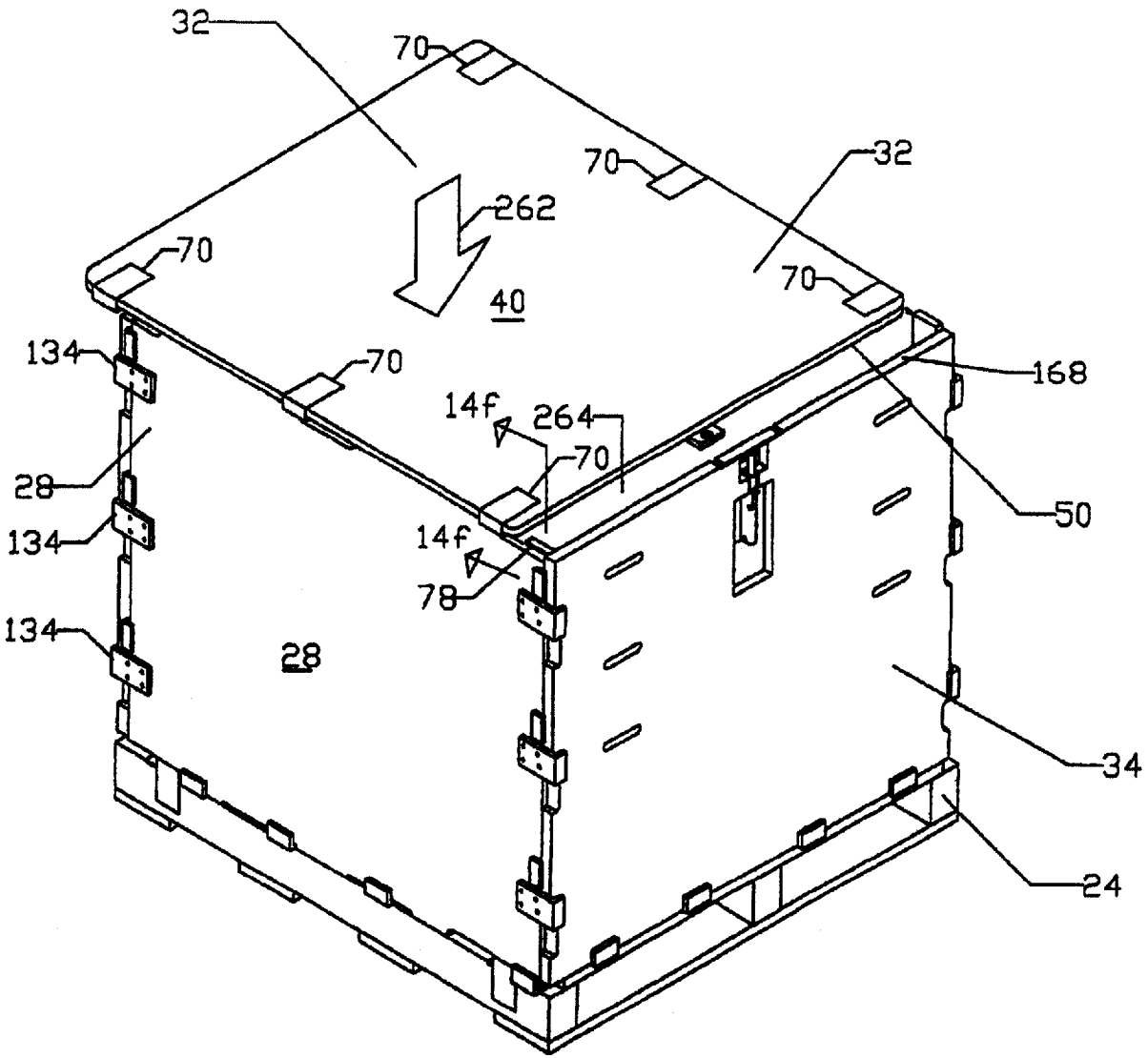
FIG. 14*d* is a perspective view of the assembled box and the lid of the container.
Figure 14F:
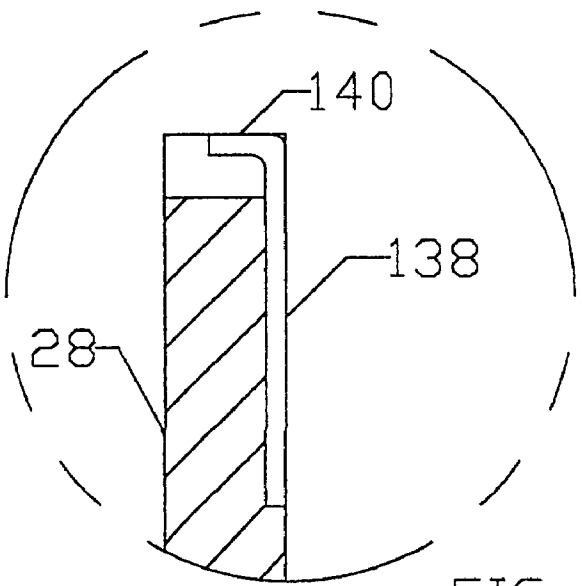
FIG. 14*f* is a section view taken along line 14*f*—14*f* of FIG. 14*d;*
Figure 14E:
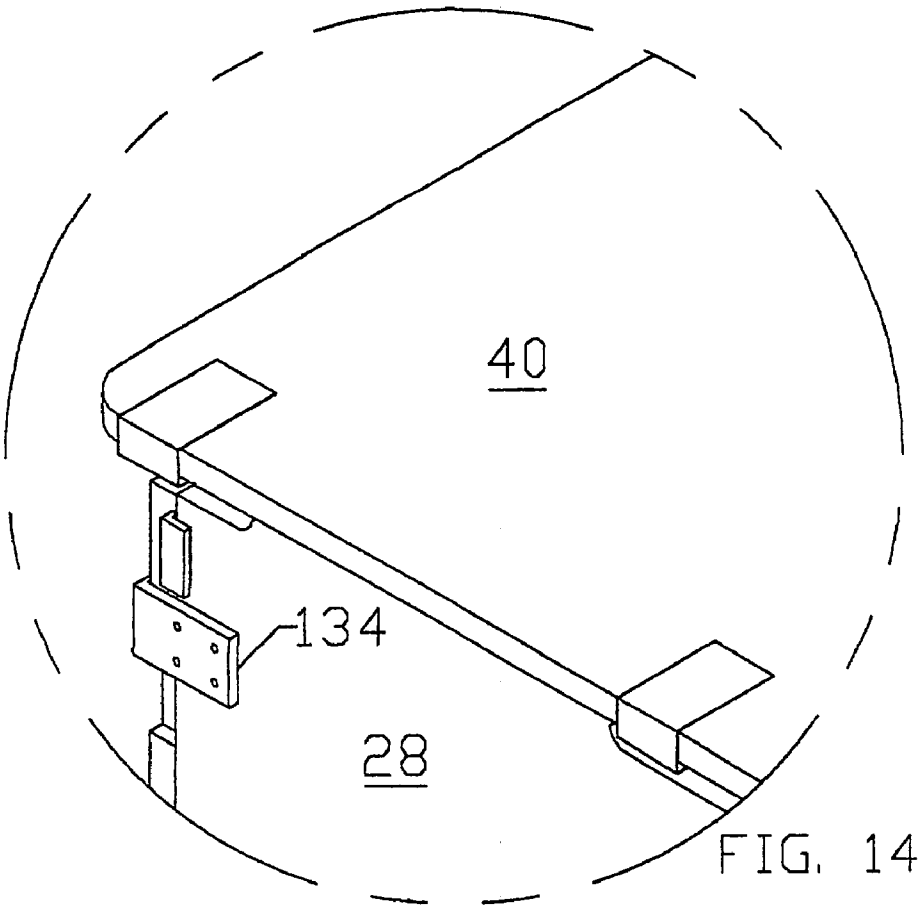
FIG. 14*e* is a detailed view of FIG. 14*d;*
Figure 14G:
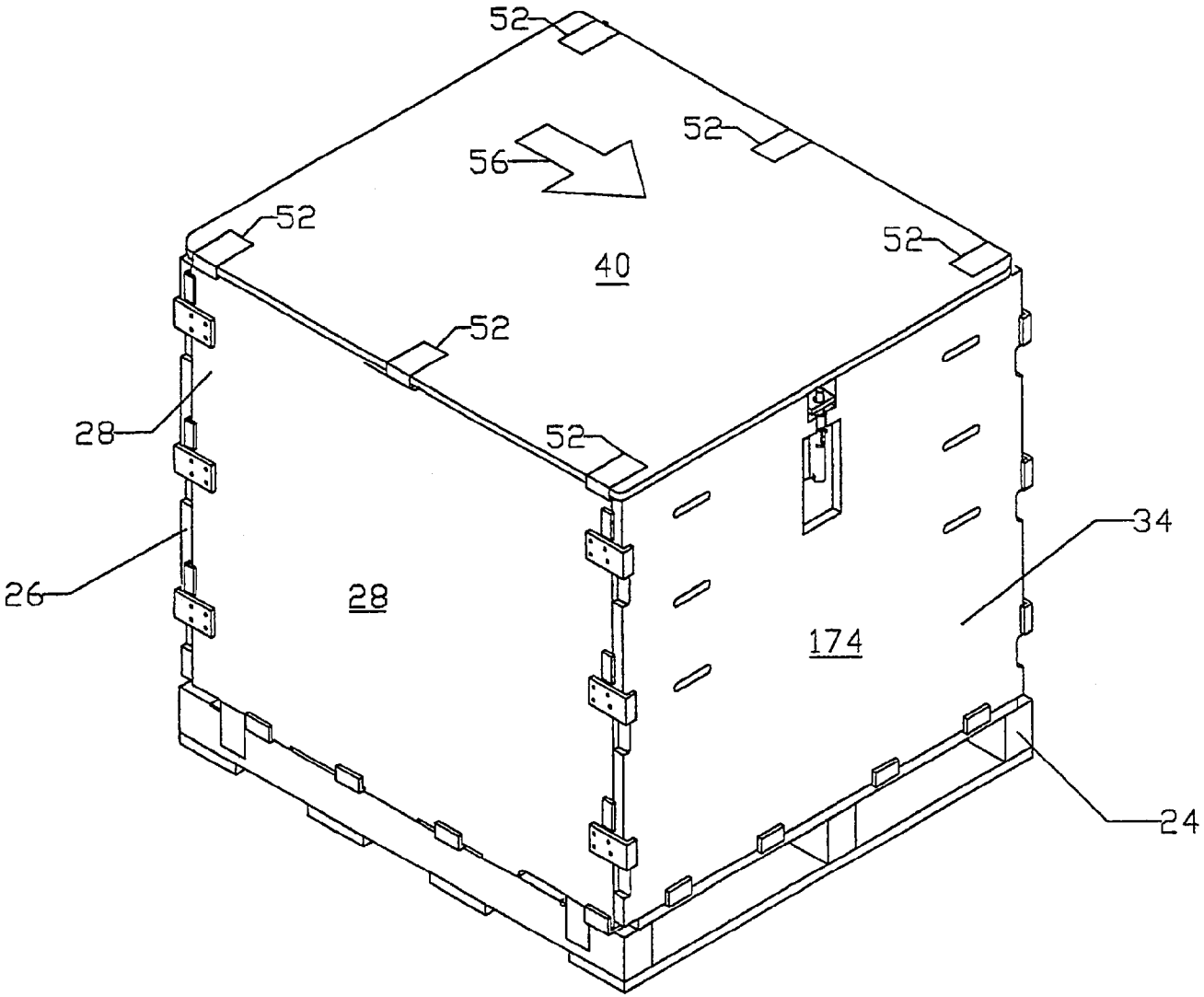
FIG. 14*g* is a perspective view of the assembled box, base and the lid of the container.

Referring initially to FIG. 14*g,* assembled container 22 is depicted. Container 22 is made up of base member 24, back side wall 26 (shown better in FIG. 13*c*), left side wall 28, right side wall 30 (shown in FIG. 13*c*), lid 32 and front wall 34. Assembled container 22 forms a generally cube-shaped cavity 36 (FIG. 13*c*) between base 24, walls 26, 28, 30 and 34 and lid 32. Lid 32 is in its first position with the lid covering the cavity and adjacent walls 26, 28, 30 and 34.

Figure 1:
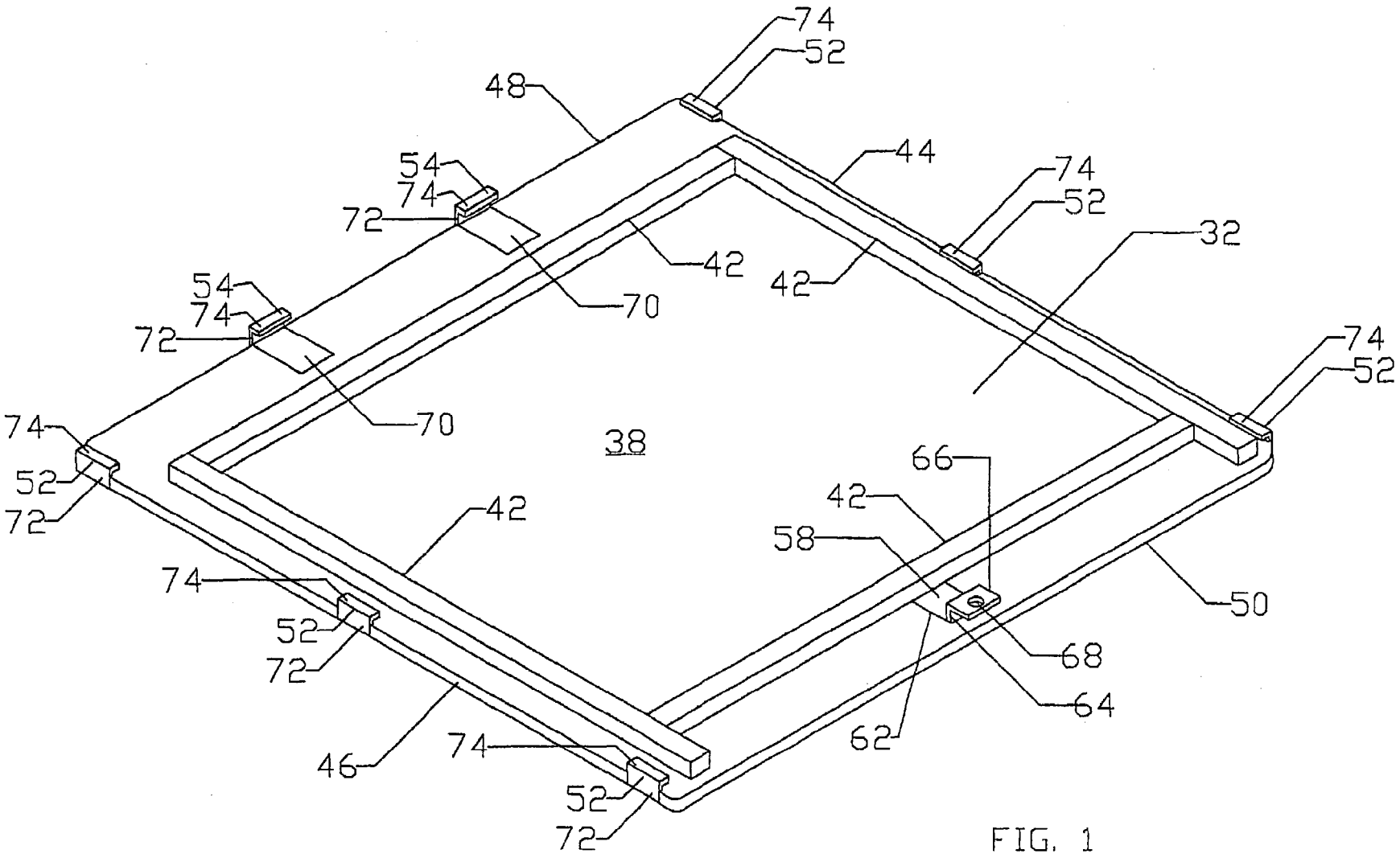
FIG. 1 is a perspective view of the bottom side of the lid of the container of the present invention.
Figure 2:
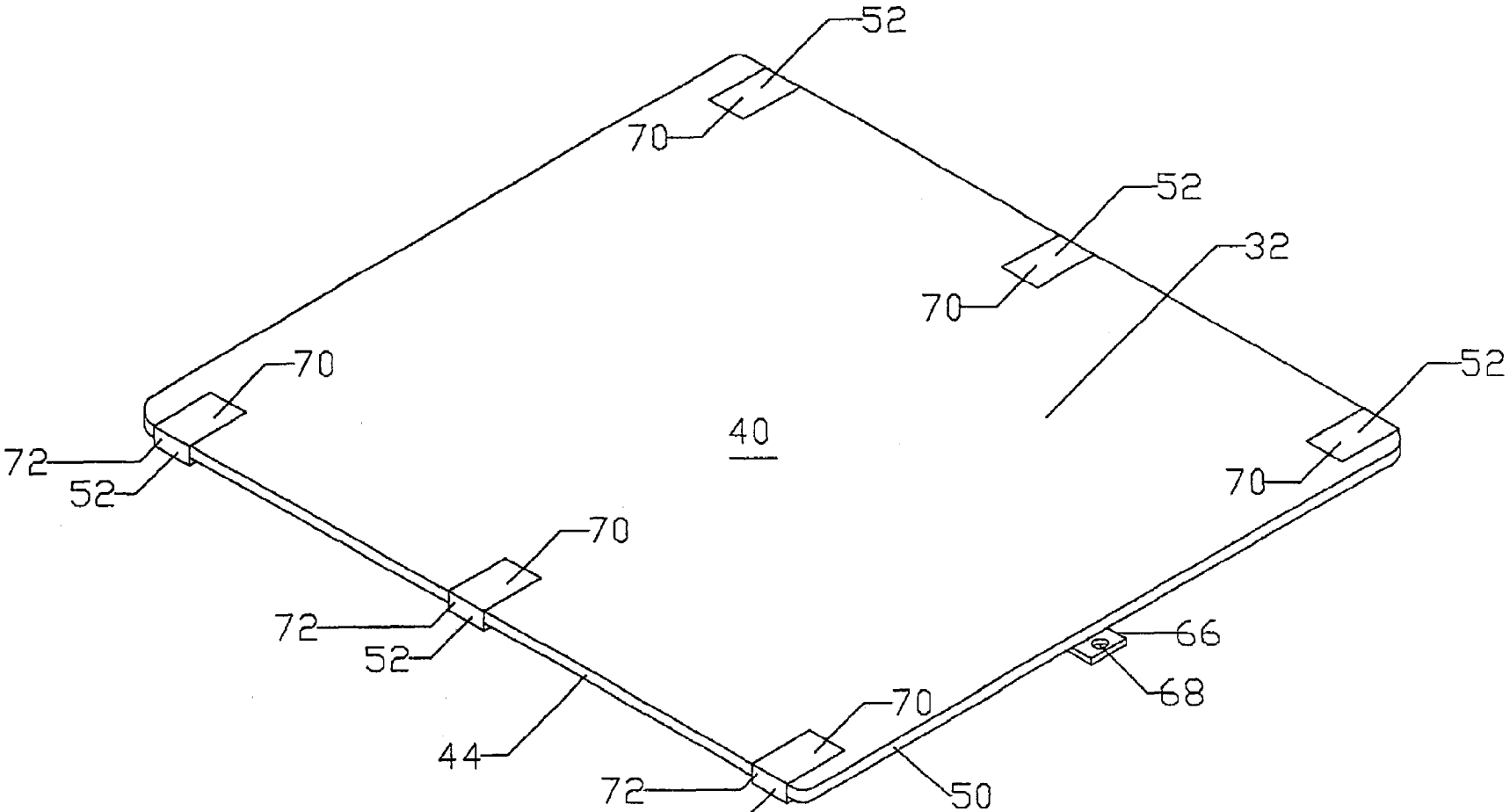
FIG. 2 is a perspective view of the top side of the lid of the container.

Referring to FIGS. 1 and 2 lid 32 includes inner face 38 which covers the upper portion of the cavity when container 22 is assembled and outer face 40 which forms the upper and outer periphery of assembled container 22. Four reinforcing members 42 are positioned generally adjacent the outer periphery of lid 32 to provide reinforcement to lid 32. Members 42 are positioned adjacent left edge 44 and right edge 46 and are offset from rear edge 48 and front edge 50 of lid 32. As depicted in FIG. 14*d* reinforcing member 42 adjacent edge 48 is positioned to permit positioning of lid 32 on walls 26, 28, 30 and 34 in an offset manner with all members 42 within cavity 36 in close proximity with corresponding walls 26, 28, 30 and 34. This positions lid 32 in its second position. This permits proper positioning of lid 32 adjacent these walls slideable between its second and first positions in a forward direction (i.e. in the direction of arrow 56 of FIG. 14*g*) to engage the lid side engagement members 52 (FIGS. 1 and 14*g*) and the lid rear engagement members 54 (FIG. 1) as will be described in more detail below.

Referring to FIG. 1, flange 58 is attached to face 38 adjacent front edge 50 of lid 32. Flange 58 includes relatively longer securing section 62 connected to lateral connecting section 64 which, in turn, is attached to extension section 66. Extension section 66 is generally in a parallel plane with the plane of securing section 62 and both are in the same plane as the lid plane defined by lid 32. Extension section 66 includes opening 68 extending through extension section 66.

Engagement members 52 are identical to engagement members 54 and both members 52 and 54 include relatively longer securing sections 70 attached to lateral connecting section 72 which, in turn, are attached to extension sections 74 extending in the same direction as securing section 70, lying in a plane parallel with securing sections 70 and overlying sections 70. As seen best in FIG. 14*c* lid side engagement member 52 is countersunk into lid 32 to provide a smooth outer face 40. Connecting section 72 is dimensioned in length such that extension section 74 forms a gap 76 of predetermined width slightly greater than the thickness of corresponding side wall engagement members 78 to enable sections 72 to engage with corresponding members 78, as is described in more detail below.

Referring to FIG. 1, lid rear engagement members 54 are countersunk into inner face 38 to provide a generally smooth surface. Preferably, engagement members 80 (FIG. 6) are oriented with respect to engagement members 54 such that slots 82 are aligned with extension section 74 when lid 32 is positioned on walls 26, 28, 30 and 34. This reduces the number of unique hardware components required for manufacture of container 22 as members 54 may then be identical to members 52.

Figure 3:
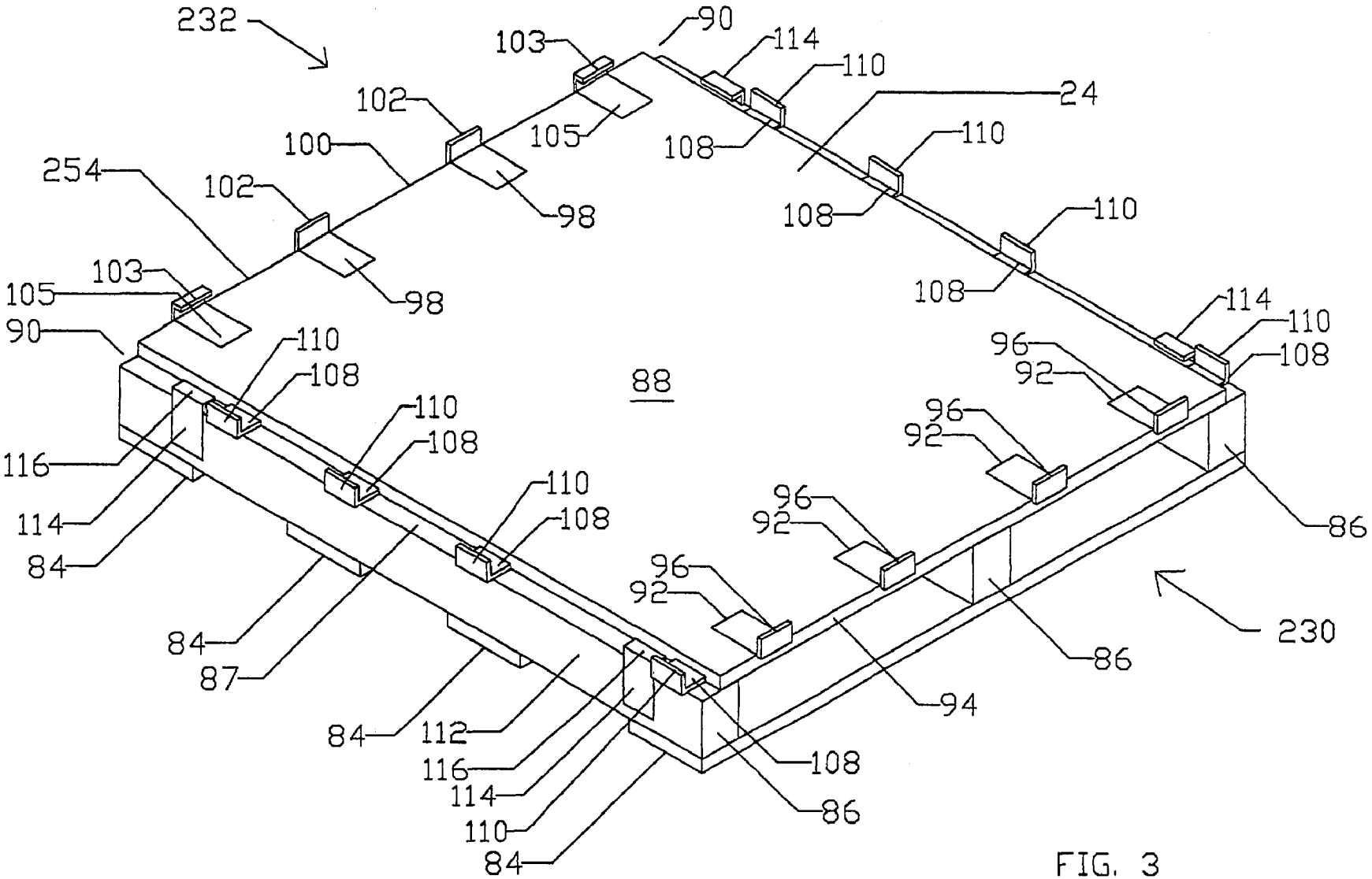
FIG. 3 is a perspective view of the base of the container of the present invention.
Figure 6:
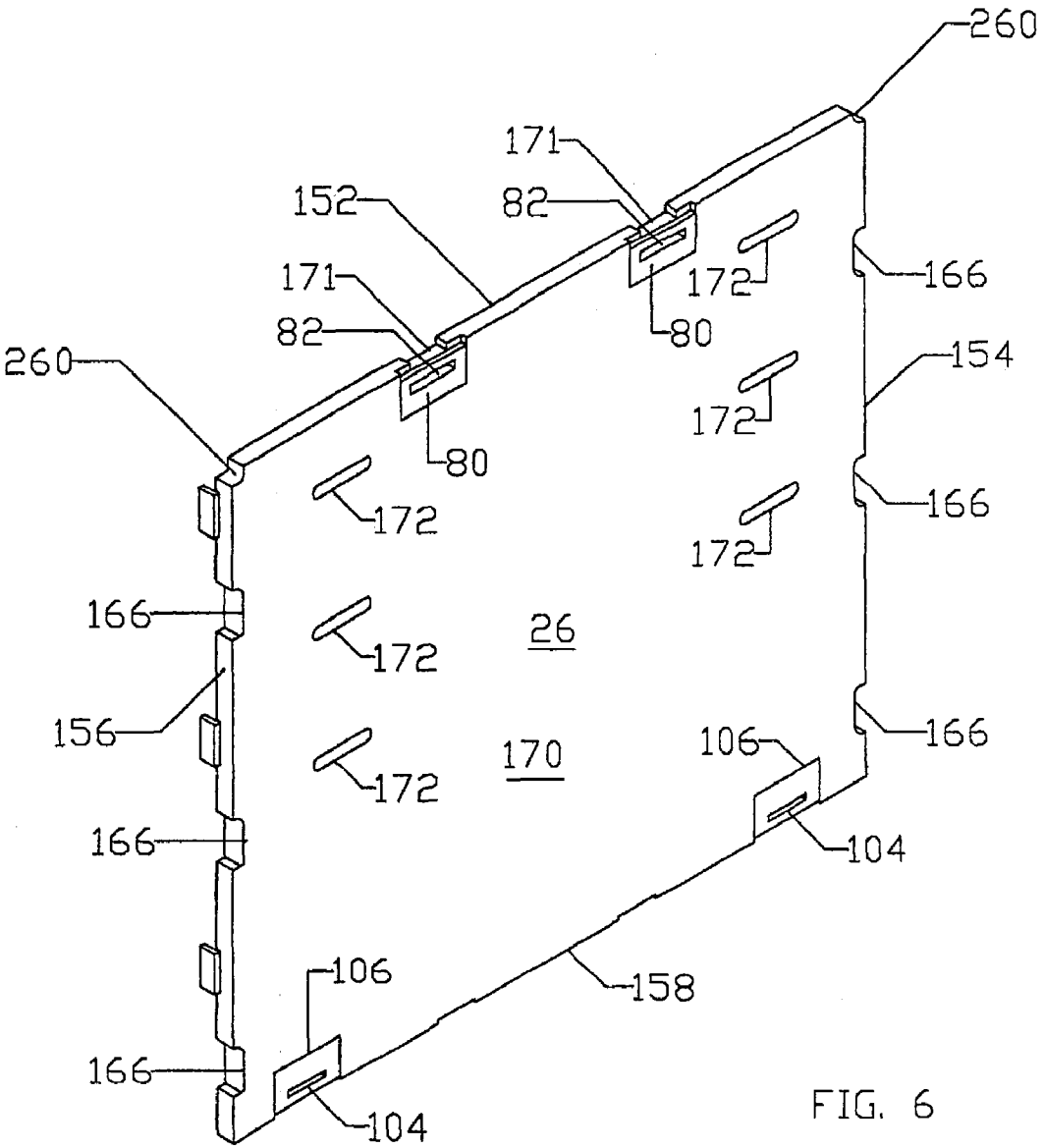
FIG. 6 is a perspective view of the exterior of the back side of the container.

Base 24 is depicted in FIG. 3. In a preferred embodiment, base 24 comprises a pallet having a plurality of parallel reinforcing bottom boards 84 connected to three parallel-spaced support skids 86 extending in a perpendicular direction as compared to the longitudinal axis of boards 84. Base panel 88 extends over most of the region between the outer opposed support skids 86 and outer boards 84, accept for a gap region 90 on each side of base panel 88 adjacent each outer support skids 86. A plurality of L-shaped front support members 92 are positioned along front edge 94 of panel 88 with extension members 96 extending upwardly with the inner face of extensions 96 coplanar with edge 94. Similarly, a pair of L-shaped rear support members 98 are positioned adjacent the rear edge 100 of panel 88. Extensions 102 extend upwardly with inner faces of extensions 102 generally coplanar with rear edge 100. Preferably, front support members 92 are identical to rear support members 98 to reduce the number of hardware components required for manufacture of container 22. A pair of rear attachment members 105 are countersunk into panel 88 adjacent the outer ends of rear edge 100. Attachment members 105 are preferably identical to lid rear engagement members 54 and attachment members 105 are dimensioned to enter corresponding slots 104 of lower rear wall engagement members 106 which are identical to rear wall engagement members 80. Lower rear wall engagement members 106 are best seen in FIG. 6.

Base 24 also includes a plurality of side support members 108 countersunk into lower face of panel 88 and sandwiched between outer support skids 86 and panel 88. Members 108 include extensions 110 extending upwardly with the inner face of extension 110 generally coplanar with outer edges 112 of outer slids 86. Support members 108 may be dimensioned identical to support members 92 and 98 to facilitate construction of container 22 by minimizing the number of unique hardware pieces required for assembly.

Base 22 further includes four attachment members 114 generally adjacent each corner of base 24 attached to and countersunk to be flush with outer faces 112 of outer skids 86. Attachment members 114 are L-shaped similar to support members 108 except that extensions 116 of members 114 are shorter than extensions 110. Attachment members 114 are positioned on skids 86 to provide a gap generally equal to the thickness of left and right wall lower engagement members 118 (FIG. 4) with left wall 28 being the mirror image of right wall 30 to permit lateral extensions 142 to be positioned between extensions 116 and outer support skids 86.

Figure 4:
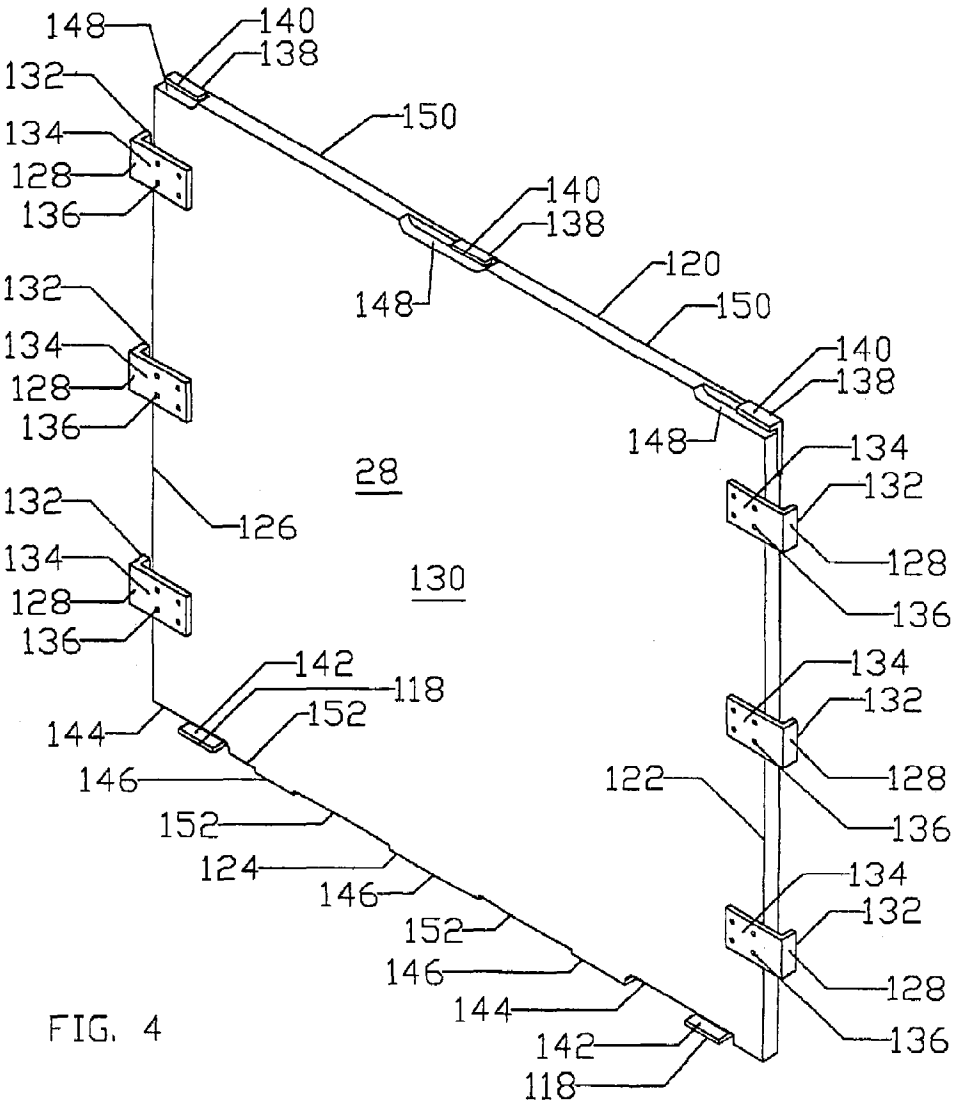
FIG. 4 is a perspective view of the exterior of the left side of the container.

Left side wall 28 will now be discussed with reference to FIG. 4. As discussed above, right side wall 30 is the mirror image of left side wall 28. Wall 28 includes top edge 120, front edge 122, bottom edge 124 and rear edge 126. Front and rear edges 122 and 126 include three L-shaped engagement members 128 attached to the exterior face 130 of left side wall 28. Engagement members 128 are positioned with extension 132 extending in a direction to lie in spaced parallel relation with respective edges 122 and 126. Preferably, members 128 are dimensioned identical to attachment members 114 to reduce the number of unique hardware components required for manufacture of container 22. Base members 134 of engagement members 128 may be attached to the exterior face 130 of left side wall 28 attached thereto by means of screws or bolts 136. Left and right lower engagement members 118 are attached to the interior face 131 (FIG. 12*g*) of wall 28 and may also be countersunk into that face. Lower engagement members 118 include lateral extension 142 extending over edge 124 in spaced relation and contained within respective front and rear edge scallop sections 144. Extension 142 is generally in coplanar alignment with non-scalloped portions 146 of edge 124 and members 118 are positioned toward the front sections 144 in the direction of edge 122.

Similarly, upper engagement members 138 are attached to the interior face 131 (FIG. 12*g*) of wall 28 and countersunk into that face. Lateral extension 140 extends over respective front, middle and rear upper scalloped portions 148 and is oriented in spaced parallel relation with the edge of scalloped portions 148 in general coplanar alignment with non-scalloped portions 150 of edge 120. Engagement members 138 are positioned adjacent the front portion of middle and rear scalloped members 148, that is toward front edge 122. Rear scallop portion 148, adjacent to edge 126, is smaller than middle and front scallop portions 148 and engagement member 138 is oriented generally over rear scalloped portion 148. Lower engagement members 118 are identical to upper engagement members 138.

Bottom edge 124 includes three indented portions 152 extending inwardly from non-scalloped portions 146 a distance less than the distance of indent of scalloped sections 144. Indented portions facilitate sliding of wall 28 along gap 90 of base 24 without interference from members 108.

Figure 5:
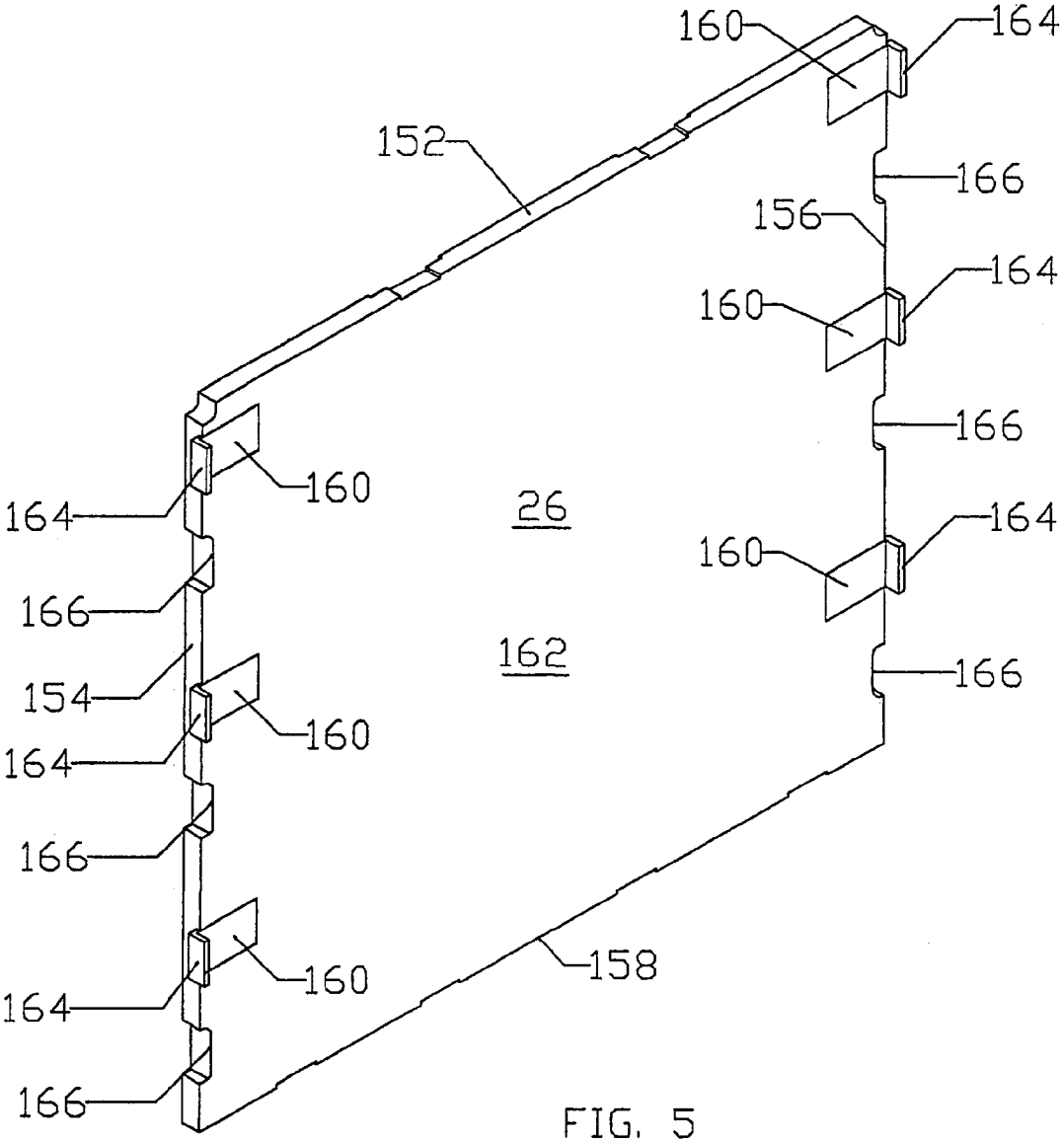
FIG. 5 is a perspective view of the interior of the back side of the container.

Back side wall 26 will be discussed with reference to FIG. 5 which depicts the interior face 162 of wall 26 and FIG. 6 which depicts the exterior face 170 of wall 26. Back side wall 26 includes top edge 152, left edge 154, right edge 156 and bottom edge 158. Six L-shaped guide members 160 are attached to the interior face 162 of wall 26 and may be countersunk into face 162. Guide members 160 include lateral extension 164 extending toward the interior of the container when assembled in general coplanar alignment with left and right edge 154 and 156. Left and right edges 154 and 156 include three indented regions 166 which are positioned such that extensions 132 of engagement members 128 (FIG. 4) may extend through indented region 166 when wall 26 is positioned adjacent rear edge 126 with top edge 152 of wall 26 raised slightly above top edge 120 of left side 28 and right side 30 (as depicted in FIG. 12*c*).

Guide members 160 may be dimensioned identical to attachment member 114 and 128 to further reduce the number of unique components required to for container 22.

A pair of rear lid engagement members 80 having slots 82 are positioned adjacent edge 152 and positioned to engage extension section 74 of lid 32 (FIG. 1) when lid 32 is positioned above cavity 36 to cover top edges 120, 152 and 168 of an assembled container 22. Lower rear wall engagement members 106 are positioned adjacent bottom edge 158 with slots positioned to engage with extensions 103 of attachment members 105 (FIG. 3) when wall 26 is positioned above base 88 when container 22 is assembled, as best depicted in FIGS. 12*c* and 12*e*. Preferably, members 80 are identical to members 106.

Members 80 include indented regions 171 which facilitate movement of securing sections 70 past top edge 152 on movement of lid 32 in the direction of arrow 56 (FIG. 14*g*) from its second position, depicted in FIG. 14*d* to its first position as depicted in FIG. 14*g*. Outer face 170 includes six capsule-shaped indented regions 172 which provide hand grips for manual manipulation of wall 26 to facilitate assembly and disassembly of wall 26 when container 22 is assembled or disassembled.

Front wall 34 will be discussed with reference to FIG. 7 which depicts the interior face 174 of wall 34 and FIG. 8 which depicts the exterior face 186 of wall 34. Interior face 174 includes six L-shaped guide members 176 which are dimensioned and positioned in the same manner as guide members 160 of wall 26 Members 114, 128, 160 and 176 are identical in shape. Wall 34 further includes upper edge 168, left edge 180, right edge 182 and bottom edge 184. Left and right edges 180 and 182 each include three indented regions 178 in positioned and dimensioned in an identical manner to indented regions 166 of wall 26. This permits extensions 132 on the front edges 122 of left and right side walls 28 and 30 to extend through indented regions 178 when front wall 34 is positioned adjacent edges 122 when edge 168 is slightly above edge 120 as depicted in FIG. 13*b*. Outer face 186 includes six capsule-shaped indented regions 188 positioned similarly to indented regions 172 of wall 26 for the same purposes as described above with respect to regions 172.

Figure 7:
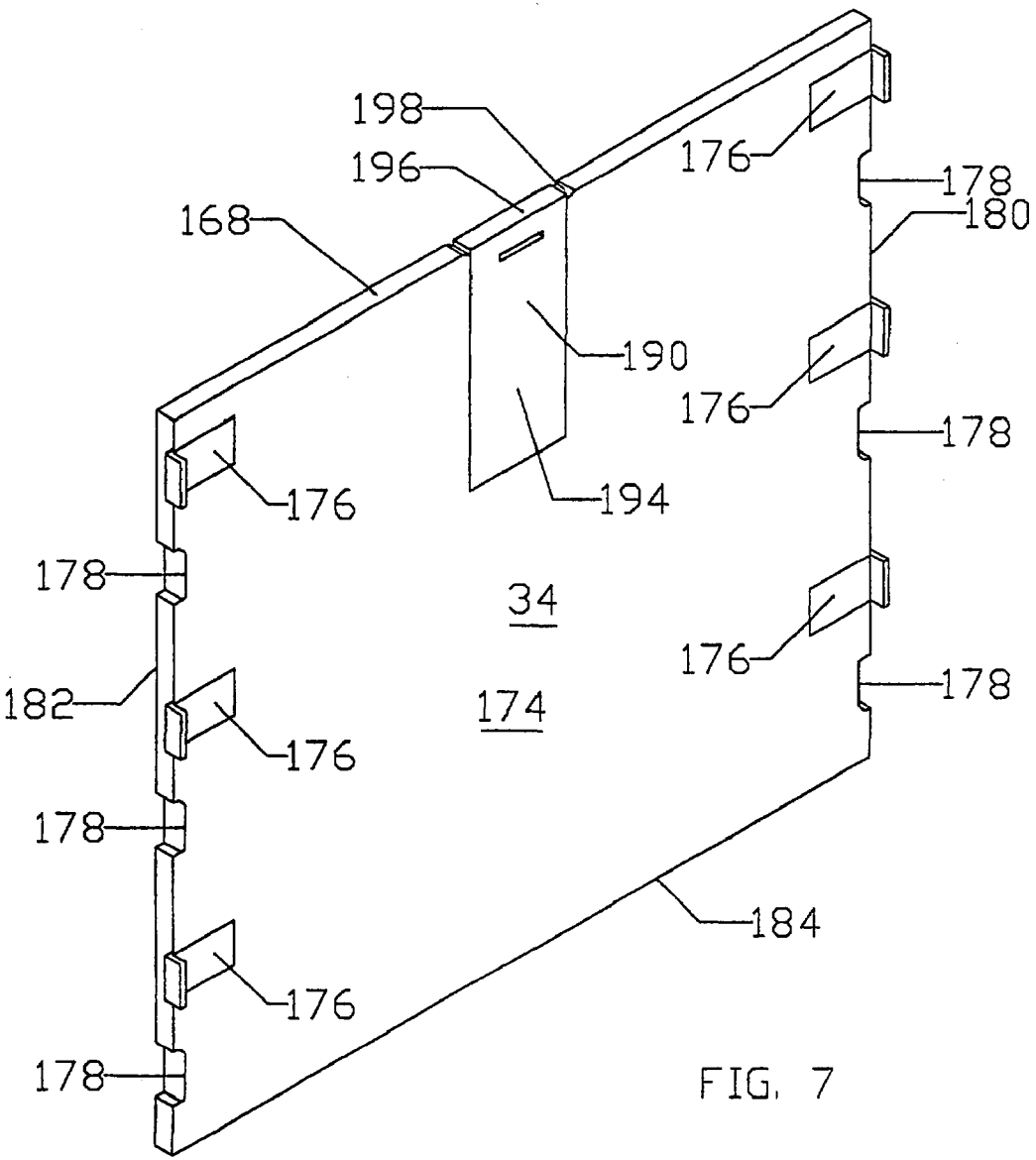
FIG. 7 is a perspective view of the interior of the front wall of the container.
Figure 8:
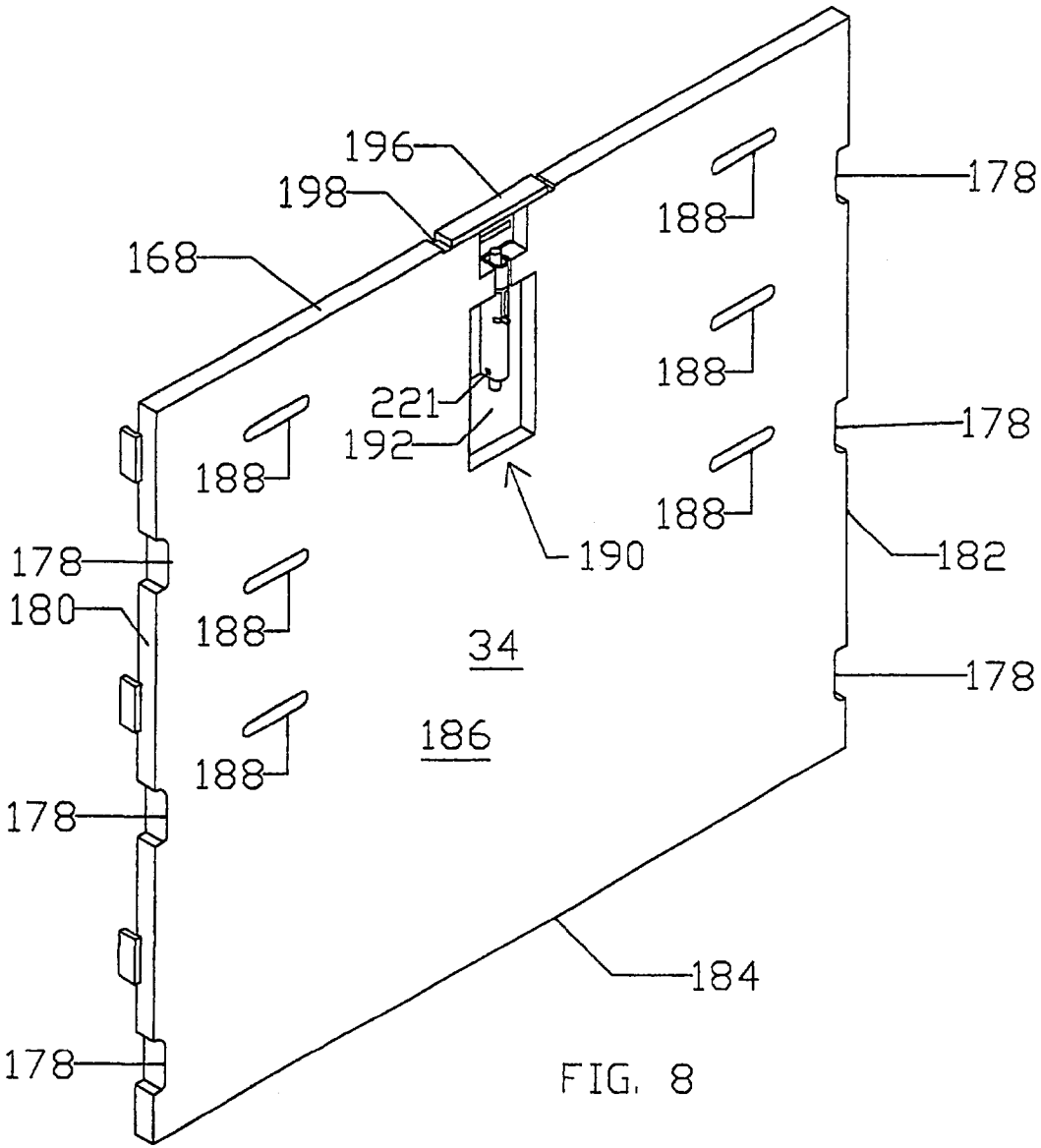
FIG. 8 is a perspective view of the exterior of the front wall of the container.
Figure 14I:
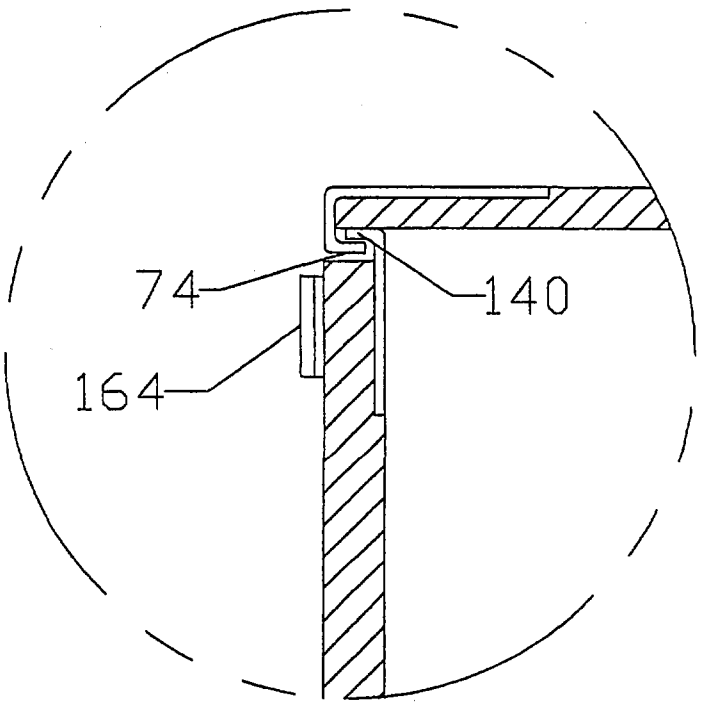
FIG. 14*i* is a section view taken along line 14*i*—14*i* of FIG. 14*h;*
Figure 14H:
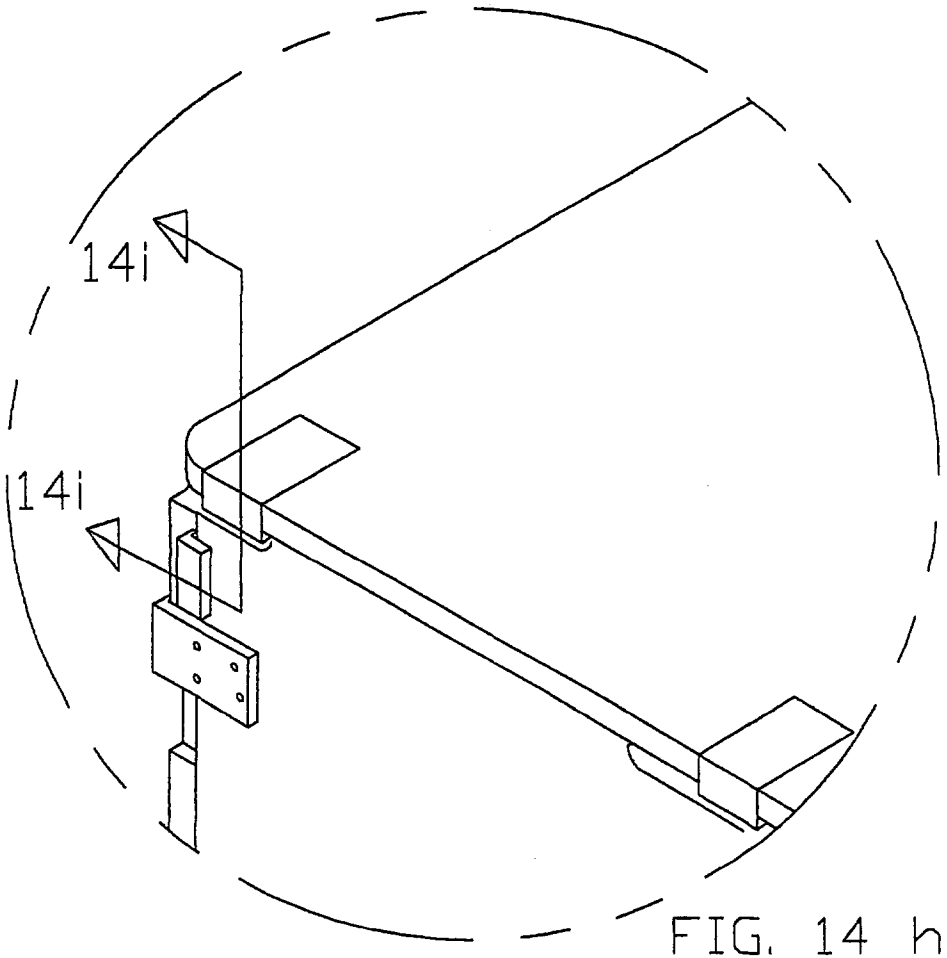
FIG. 14*h* is a detailed view of FIG. 14*g;*
Figure 14J:
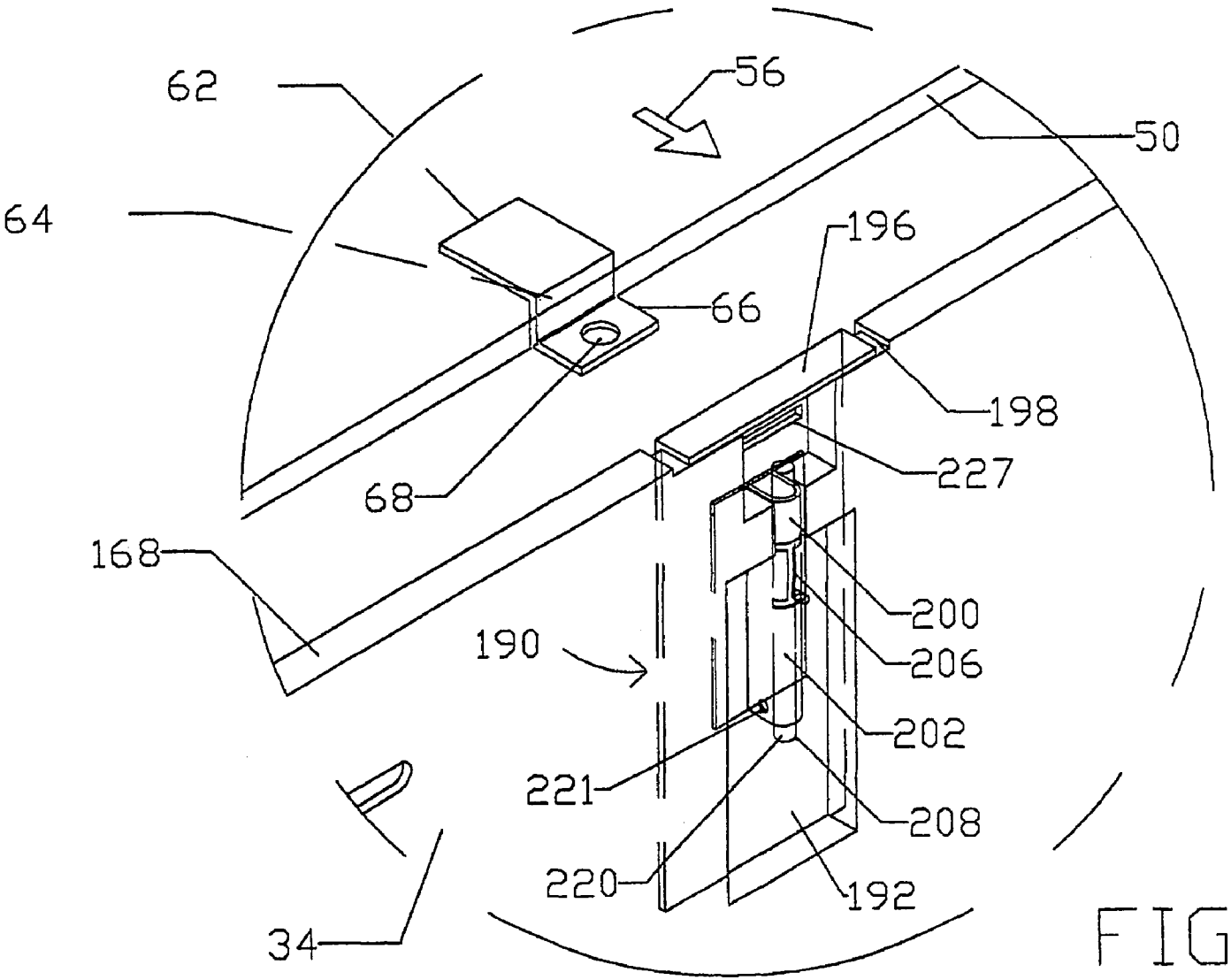
FIG. 14*j* is a detailed view of FIG. 14*d* showing the bolt and flange securing system.
Figure 14K:
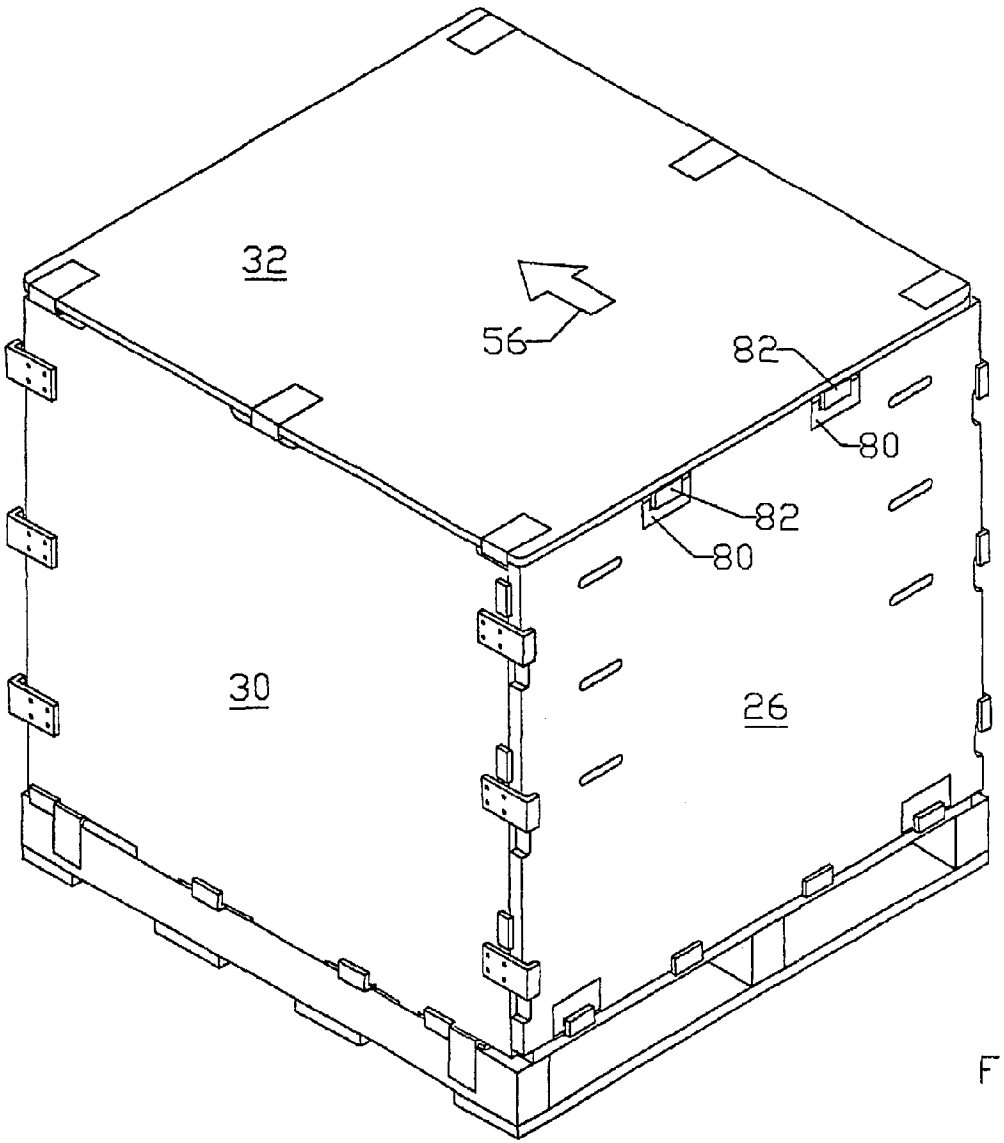
FIG. 14*k* is a perspective view from the rear of the assembled container.
Figure 14M:
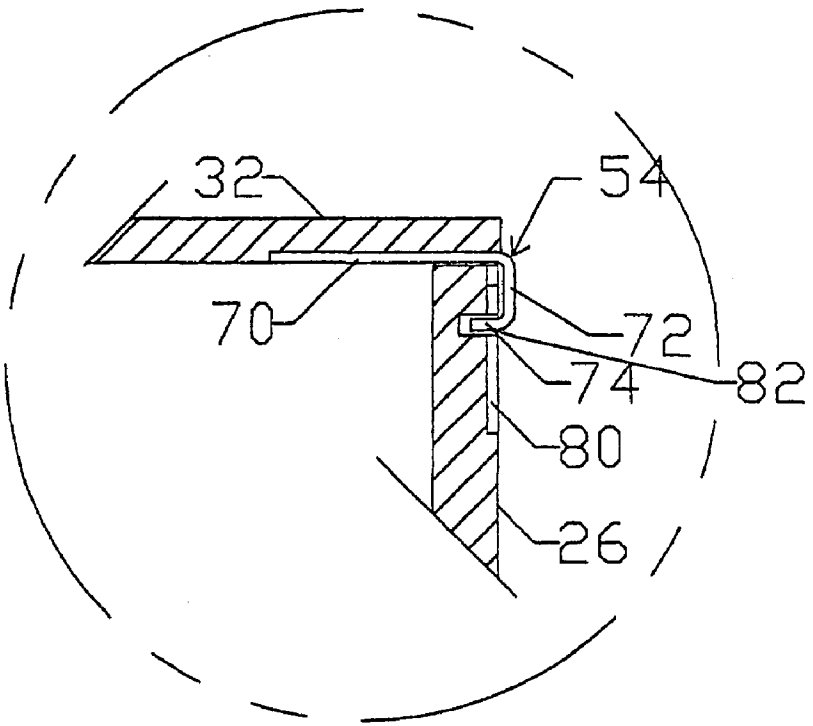
* and FIG. 14*m* is a section view taken along line 14*m*—14*m*of FIG. 14*l.*
Figure 14L:
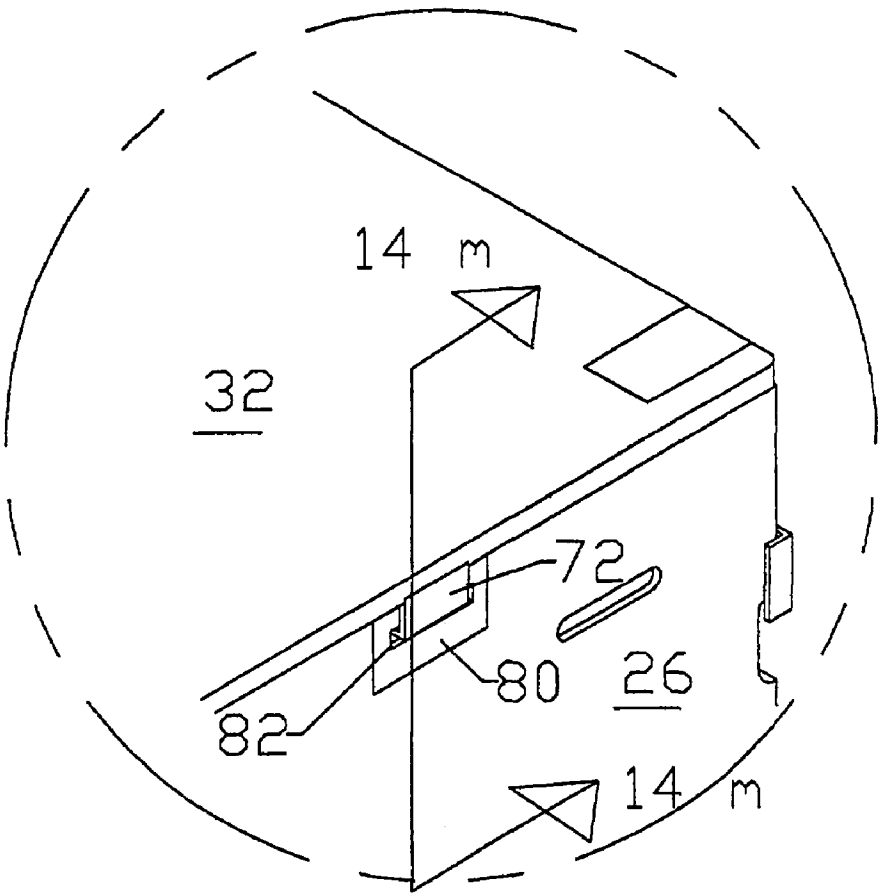
FIG. 14*l* is a detailed perspective view of a rear corner of the container of FIG. 14*k.

Referring to FIGS. 7 and 14*j* wall 34 further includes opening 192 extending through wall 34 at an upper and central region of wall 34 adjacent edge 168. Lid securing member 190 is attached to face 174 to cover opening 192. Member 190 includes base member 194 extending behind opening 192 connected to perpendicular extension 196 extending generally over upper indent 198 and upper part of opening 192 in coplanar alignment with edge 168.

Figure 9A:
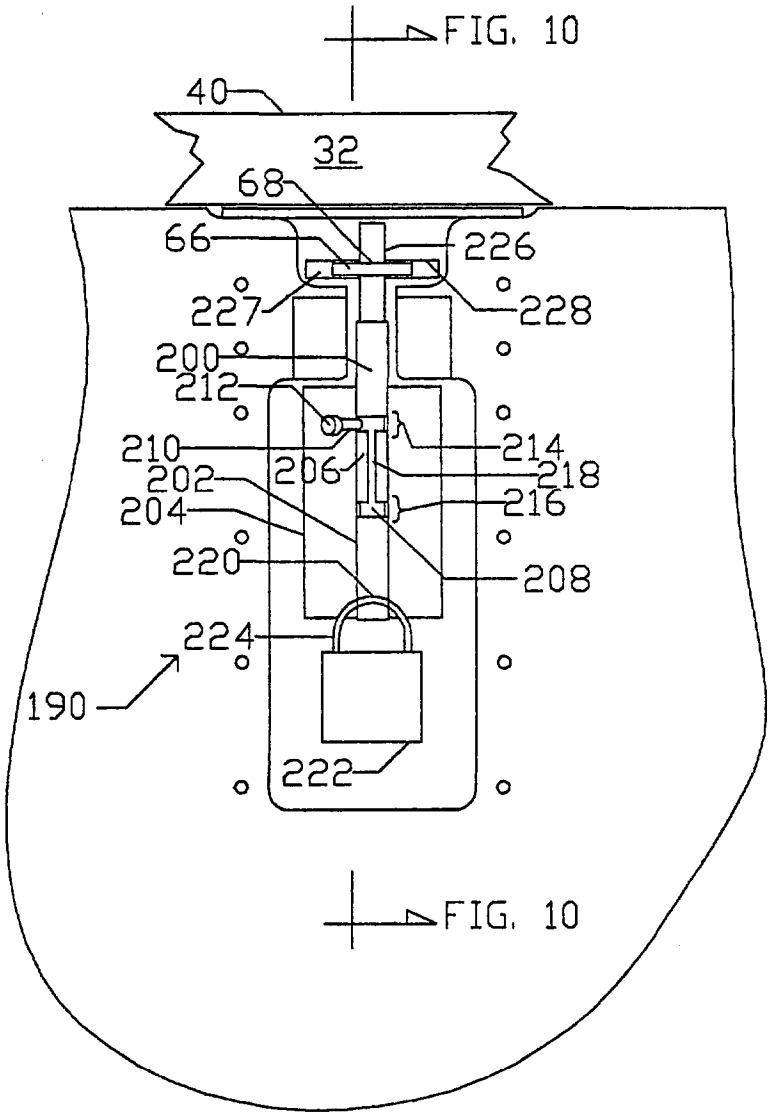
FIG. 9*a* is a front detail view of the bolt and flange securing system of the container in the secured position.
Figure 9B:
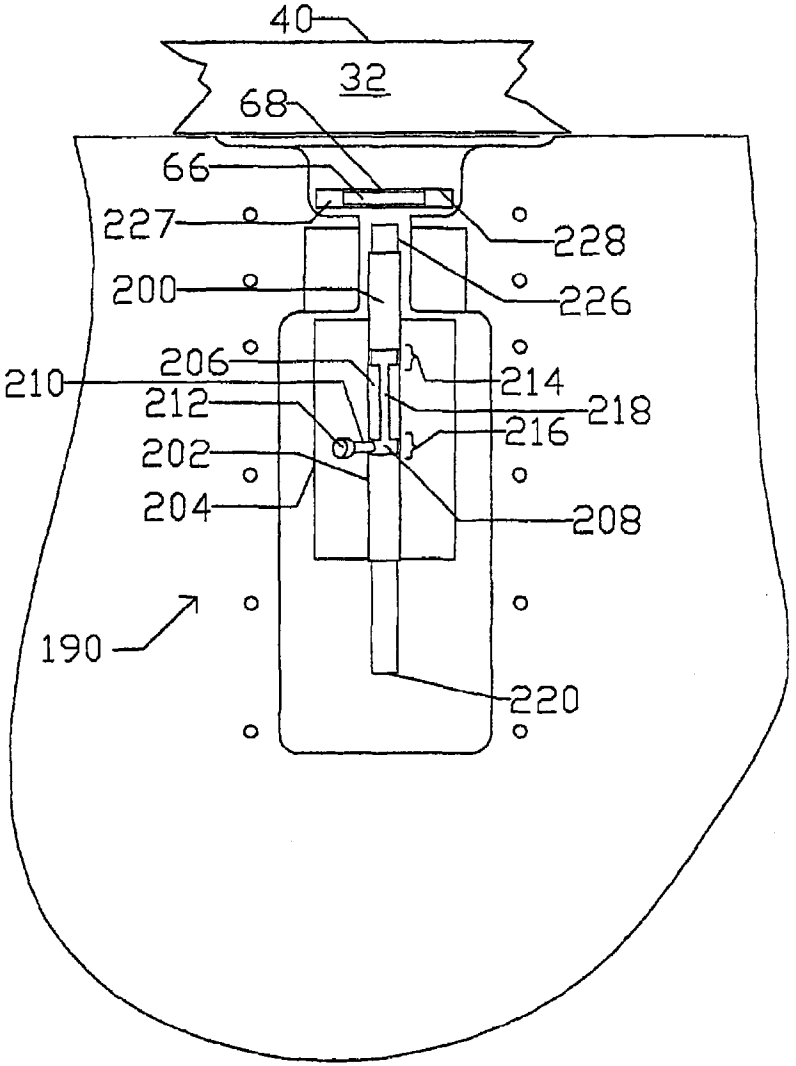
FIG. 9*b* is a front detail view of the bolt and flange securing system of the container in the unsecured position.

Referring to FIGS. 9*a*, 9*b*, 10 and 14*j*, lid securing member 190 is shown in detail. Upper guide 200 and lower guide 202 are attached to support plate 204 which is attached to base member 194 to extend into opening 192. Slotted guide 206 is also attached to plate 204 in longitudinal axial alignment with and between guides 200 and 202. Bolt 208 extends longitudinally between guides 200 and 202 and is movable along the longitudinal axis of guides 200 and 202 between a secured position (shown in FIG. 9*a*) and an unsecured position (shown in FIG. 9*b*). Bolt 208 includes lateral extension 210 with knob 212 attached to the outer periphery of extension 210. Extension 210 is positioned in an intermediate region along bolt 208 such that on rotation of bolt 208 in the secured position, extension 210 moves between a gap 214 between upper guide 200 and slotted guide 206, as depicted in FIG. 9*a*. Referring to FIG. 9*b* when bolt 208 is in the unsecured position bolt 208 may be rotated along with extension 210 within gap 216 between lower guide 202 and slotted guide 206. Slotted guide further includes slot 218 dimensioned to permit extension 210 to move through slot 218 when bolt 208 is moved between its secured position (FIG. 9*a*) and its non-secured position (FIG. 9*b*).

Lower guide 202 includes a pair of opposed openings 221 (FIG. 8) which are aligned with one another and positioned below the bottom 220 of bolt 208 when bolt 208 is in the secured position and extension 210 is rotated so that knob 212 contacts plate 204, as depicted in FIG. 9*a*.

When bolt 208 is in the secured position the upper end 226 extends through opening 68 in extension section 66.

Lock 222 having C-shaped locking member 224 may be extended through openings 221 in lower guide 202 to be positioned below bottom 220 to lock bolt 208 in its secured position depicted in FIG. 9*a*.

Referring to FIG. 9*b*, when bolt 208 is in its unsecured position extension 210 is positioned within gap 216 and upper end 226 of bolt 208 is positioned below opening 68. This permits extension section 66 to be moved from slot 227 when lid 32 is moved in a direction toward back wall 26. When bolt 208 is in the secured position extending within opening 68 extension section 66 may not be moved toward back wall 26 and lid 32 may not be moved in a direction parallel to the lid plane. Furthermore, upwardly directed pressure applied on lid 32 in a first direction away from cavity 36, that is opposite to the direction of arrow 262 in FIG. 14*d*, will cause extension 66 to be raised upwardly until it contacts flange contact surface 228 thereby preventing further movement of lid 32 in a direction away from cavity 36, that is in the first direction.

Figure 10:
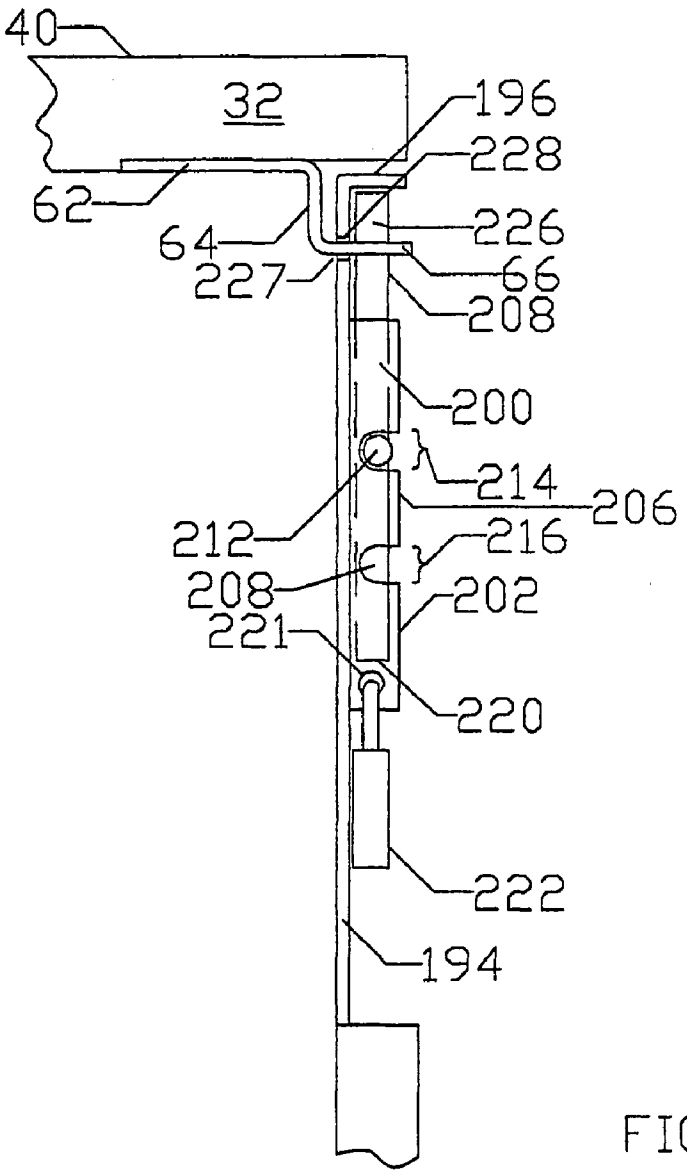
FIG. 10 is a side cross-sectional view taken along line 10—10 of FIG. 9*a;*

Referring to FIG. 10, bolt 208 is shown in its secured position with extension section 66 extending through slot 227. As discussed previously, extension section is connected to connecting section 64 which, in turn, is connected to securing section 62 rigidly attached to lid 32 and positioned on lid 32 such that extension section 66 extends through slot 227 when lid 32 covers cavity 36 and upper edges 120, 152 and 168 in the first position of lid 32.

Assembly of Container

The assembly of 22 will now be discussed with reference to FIGS. 11*a* through 14*m*.

Figure 11A:
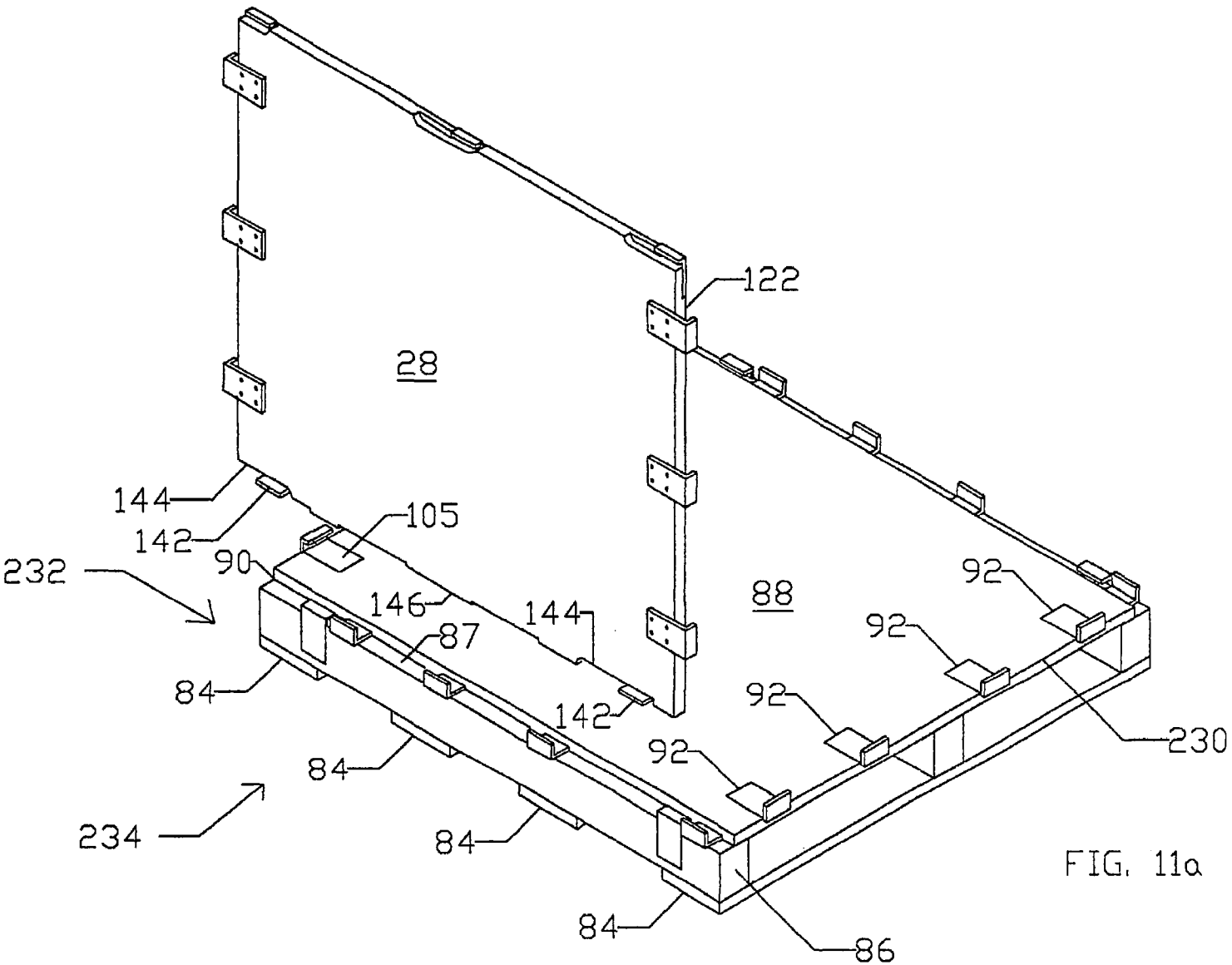
FIG. 11*a* is a perspective view of the base and left side wall of the container in spaced relation.
Figures 11B, 11C:
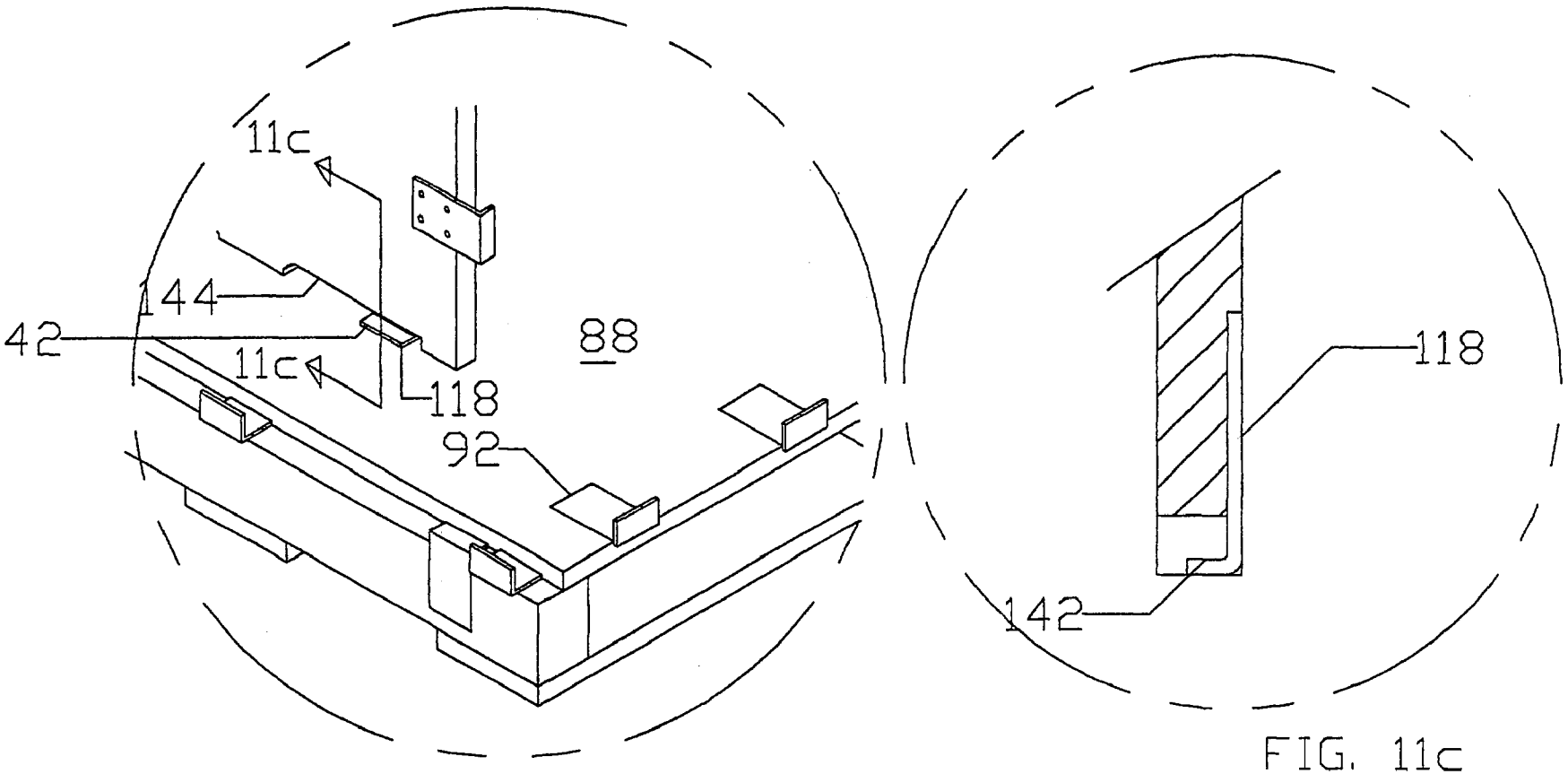
FIG. 11*b* is a close-up perspective view of the left side wall and base of the container.
FIG. 11*c* is a section view taken along line 11*c*—11*c* of FIG. 11*b;*

Referring initially to FIGS. 11*a*, 11*b* and 11*c*, boards 84, skids 86 and base panel 88 are positioned on a floor or other supporting surface with base panel 88 on top. Front end 230 of panel 88 includes four identical front support members 92 and rear end 232 includes a pair of inner rear support members 98 (FIG. 3) and a pair of outer attachment members 105 (FIG. 3) which can assist in determining the front end 230 from the back end 232 of base panel 88.

Figure 11D:
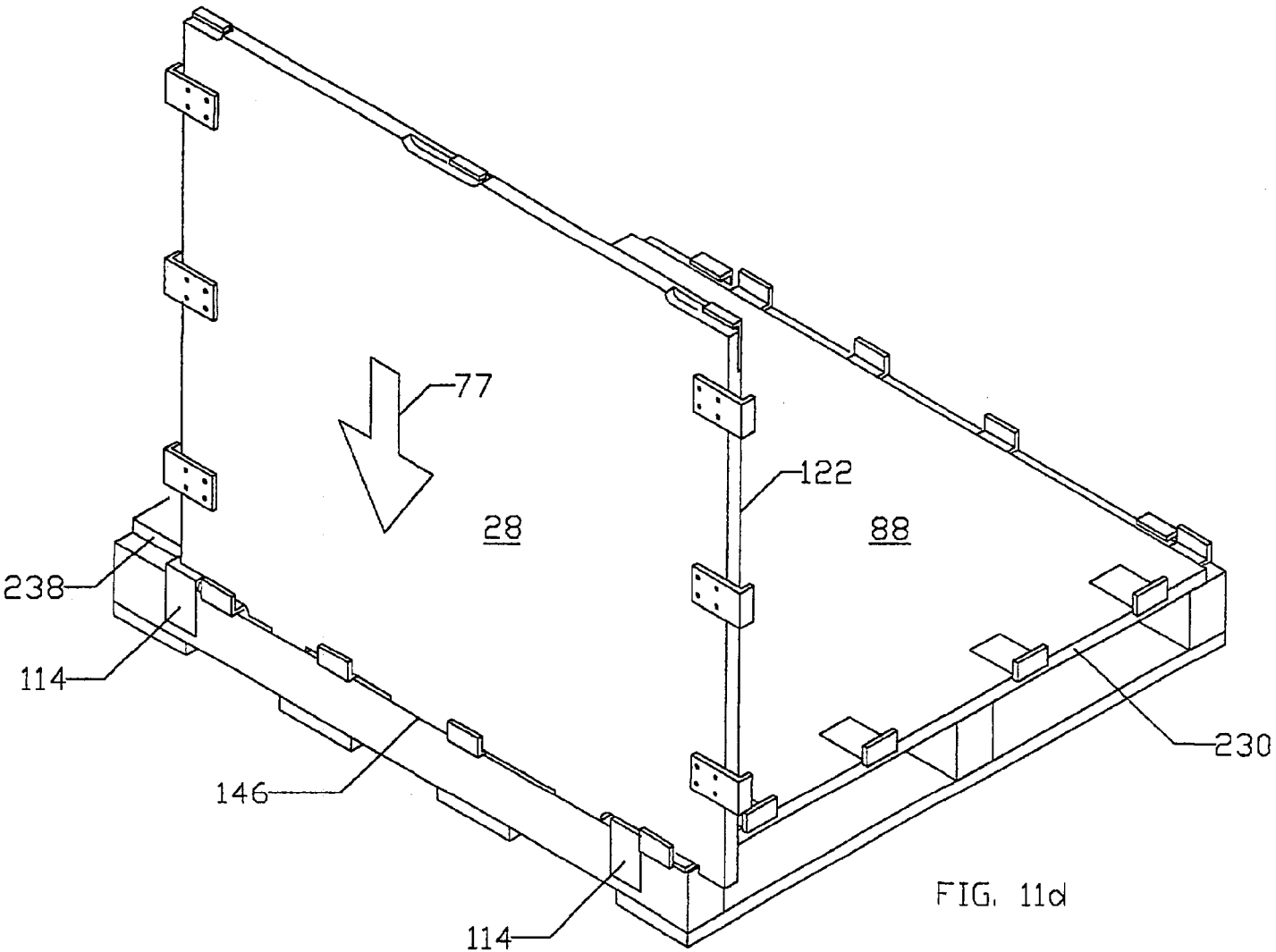
FIG. 11*d* is a perspective view of the left side wall and base of the container.

Left side wall 28 is positioned adjacent the left side 234 of panel 88, the left side identified by facing the front end 230 of container 22. Panel 28 is lowered in the direction of arrow 77 to a position where non-scalloped portions 146 rest on upper face 87 of left outer support beam 86 within gap 90, as depicted in FIG. 11*d* with front edge 122 extending beyond front end 230 of base 88. Referring to FIGS. 11*b* and 11*c*, lower engagement members 118 include extension 142 extending in spaced parallel relation with scallop sections 144. Scallop sections 144 provide sufficient clearance to permit non-scalloped portions 146 to rest on face 87 without interference from extension 142.

Figure 11F:
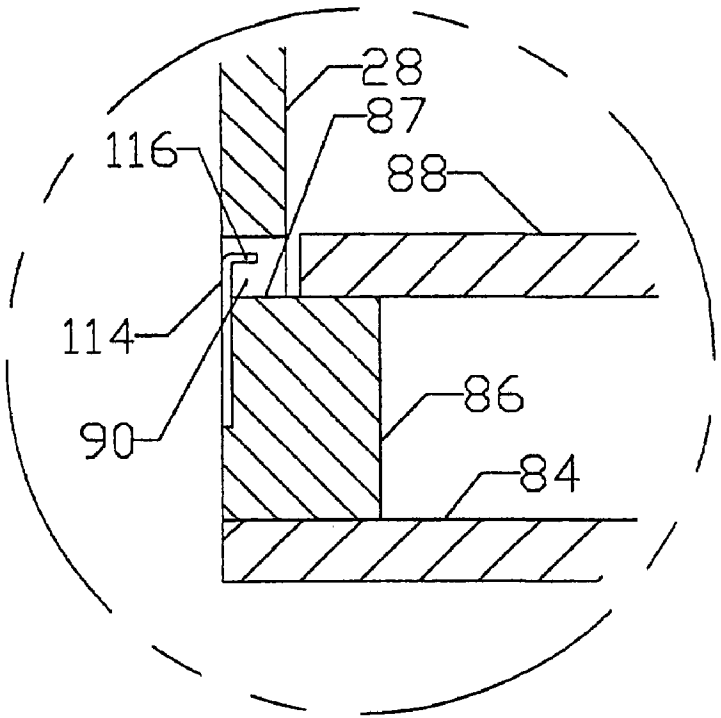
FIG. 11*f* is a section view taken along line 11*f*—11*f* of FIG.11*e;*
Figure 11E:
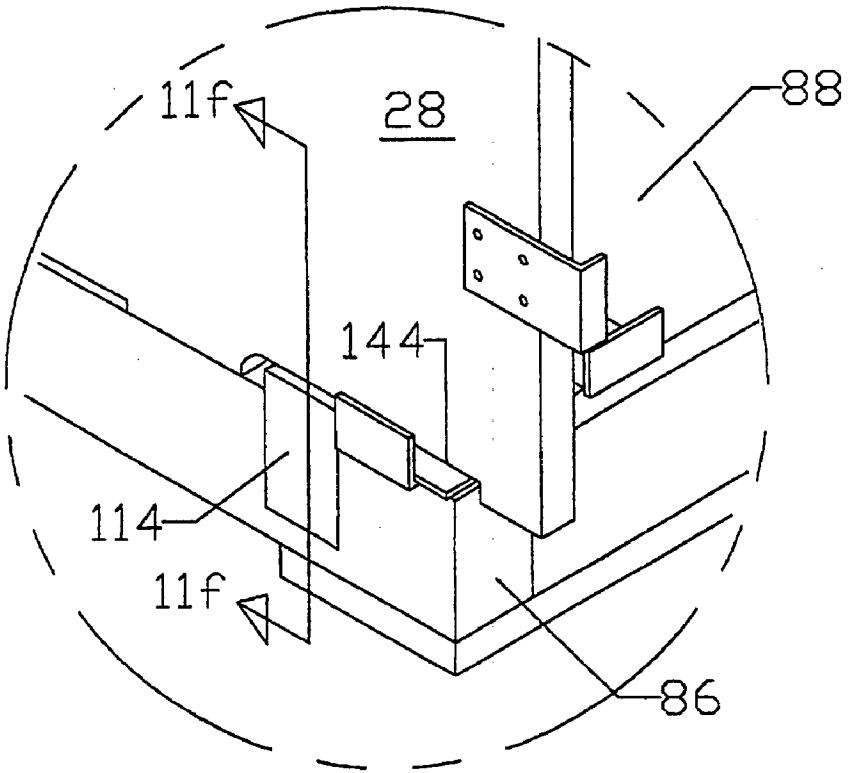
FIG. 11*e* is detailed view of FIG. 11*d;*

Referring to FIGS. 11*e* and 11*f*, attachment members 114 extend into scalloped regions 144 when wall 28 is positioned as viewed in FIG. 11*d*. Attachment member 114 includes extension 116 which extend in spaced parallel relation over upper face 87 in the region of gap 90.

Figure 11G:
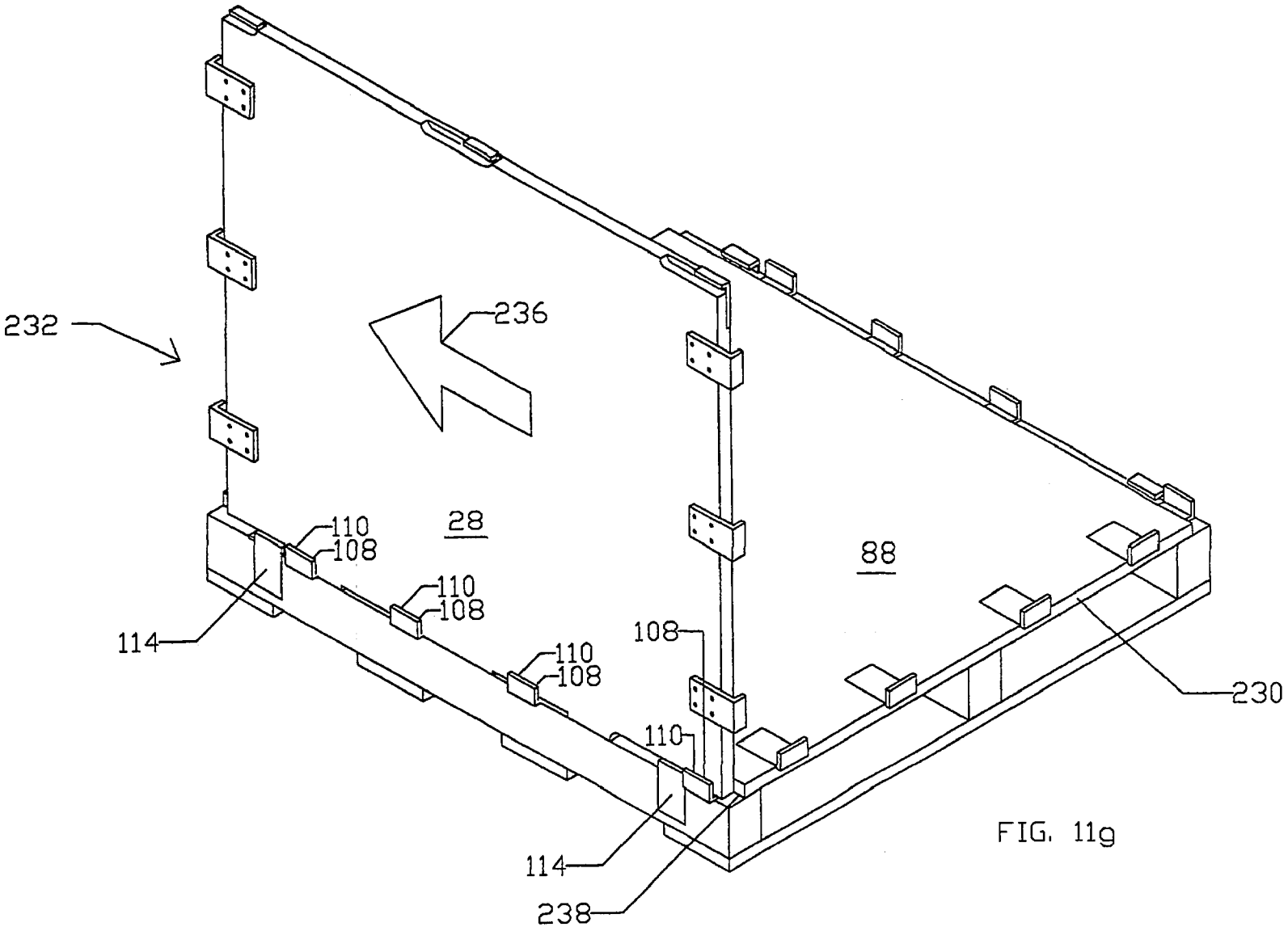
FIG. 11*g* is a perspective view of the left side wall and base of the container.
Figure 11I:
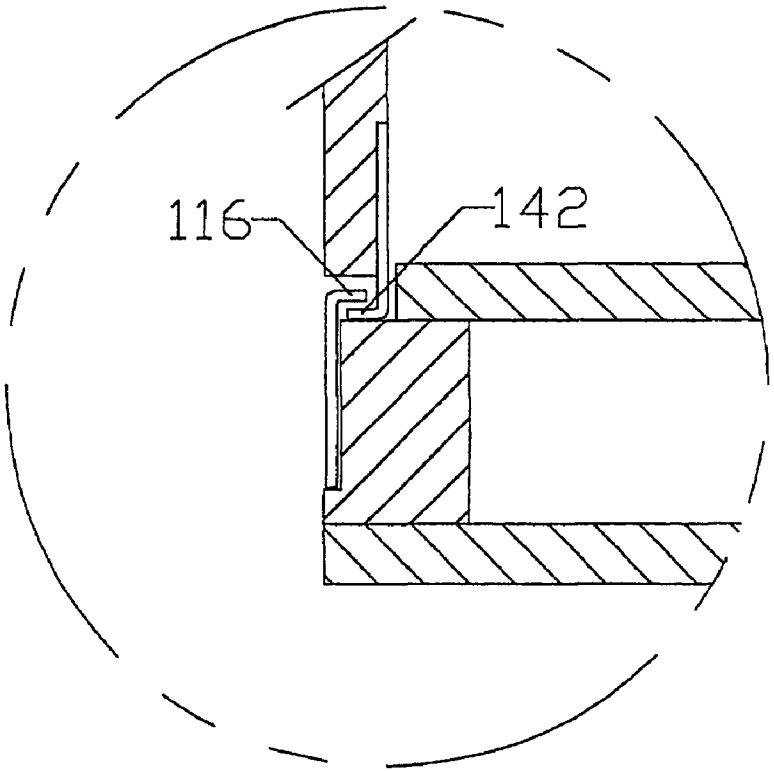
FIG. 11*i* is a section view taken along line 11*i*—11*i* of FIG. 11*h;*
Figure 11H:
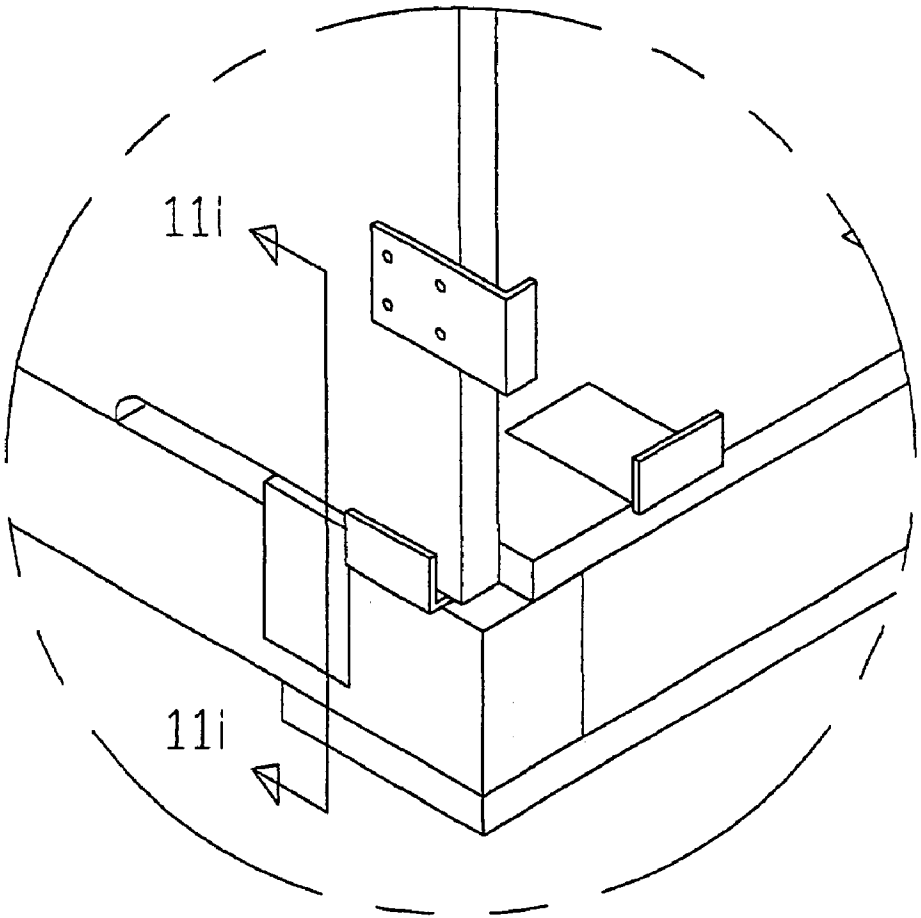
FIG. 11*h* is a detailed view of FIG. 11*g;*

Referring to FIGS. 11*g*, 11*h* and 11*i*, wall 28 is then moved in the direction of arrow 236 rearwardly toward rear end 232 of base 88. This positions extensions 116 and 142 in engagement with a portion of extension 116 extending over a portion of extension 142 as depicted in FIG. 11*i*. Extensions 110 act to support wall 28 in its positions as depicted in FIGS. 11*d* and 11*g* by sandwiching wall 28 between extension 110 and left edge 238 of base 88. Wall 28 remains in an upright position as depicted in FIG. 11*g* without further support.

Right side wall 30 is the mirror image of left side wall 28 and right side of base 88 is a mirror image of the left side of base 88. Wall 30 is attached to base 88 in the same manner as wall 28 and is depicted in its assembled position in FIG. 12*a*.

Figure 12A:
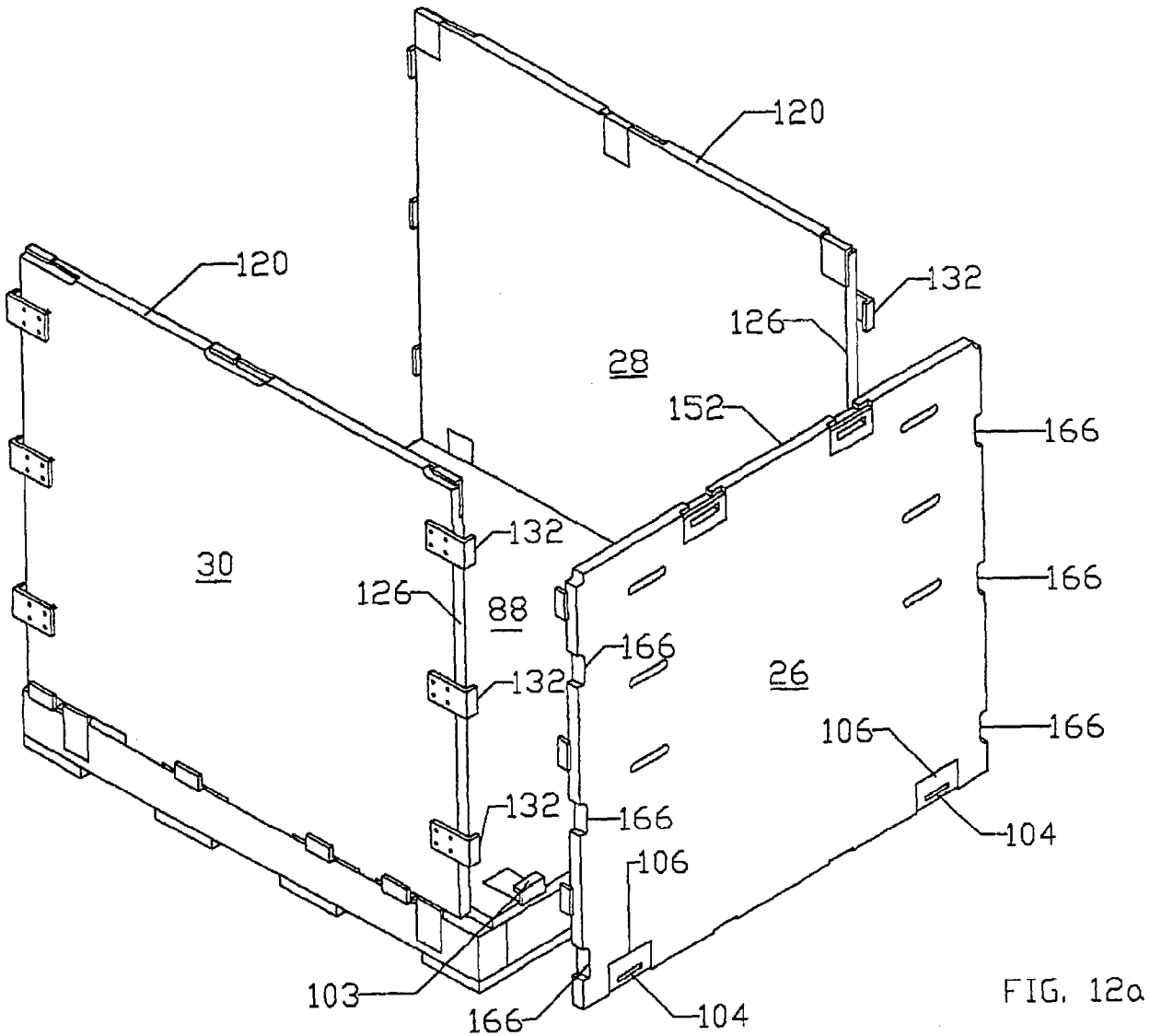
FIG. 12*a* is a perspective view of the left side, right side and rear side walls and base of the container.
Figure 12B:
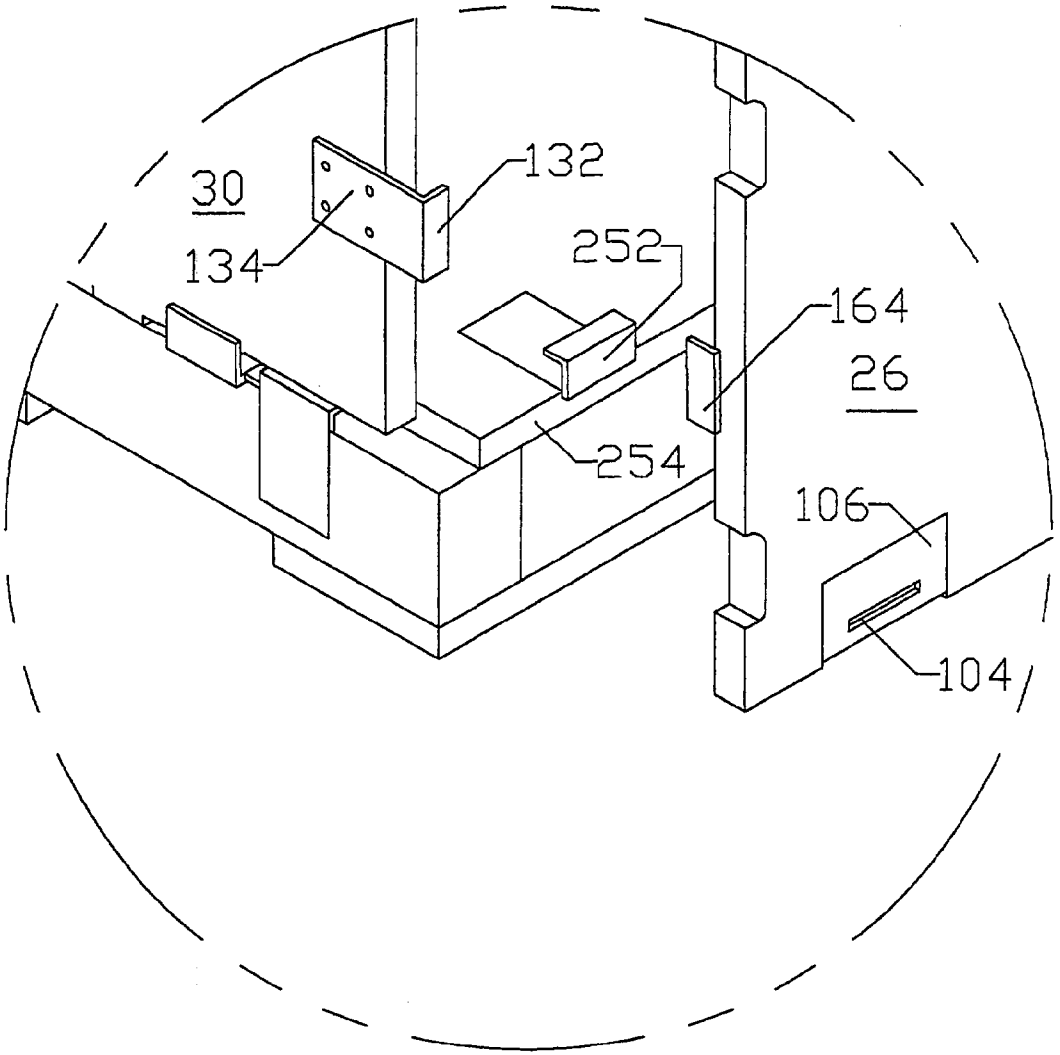
FIG. 12*b* is a detailed view of FIG. 12*a;*
Figure 12C:
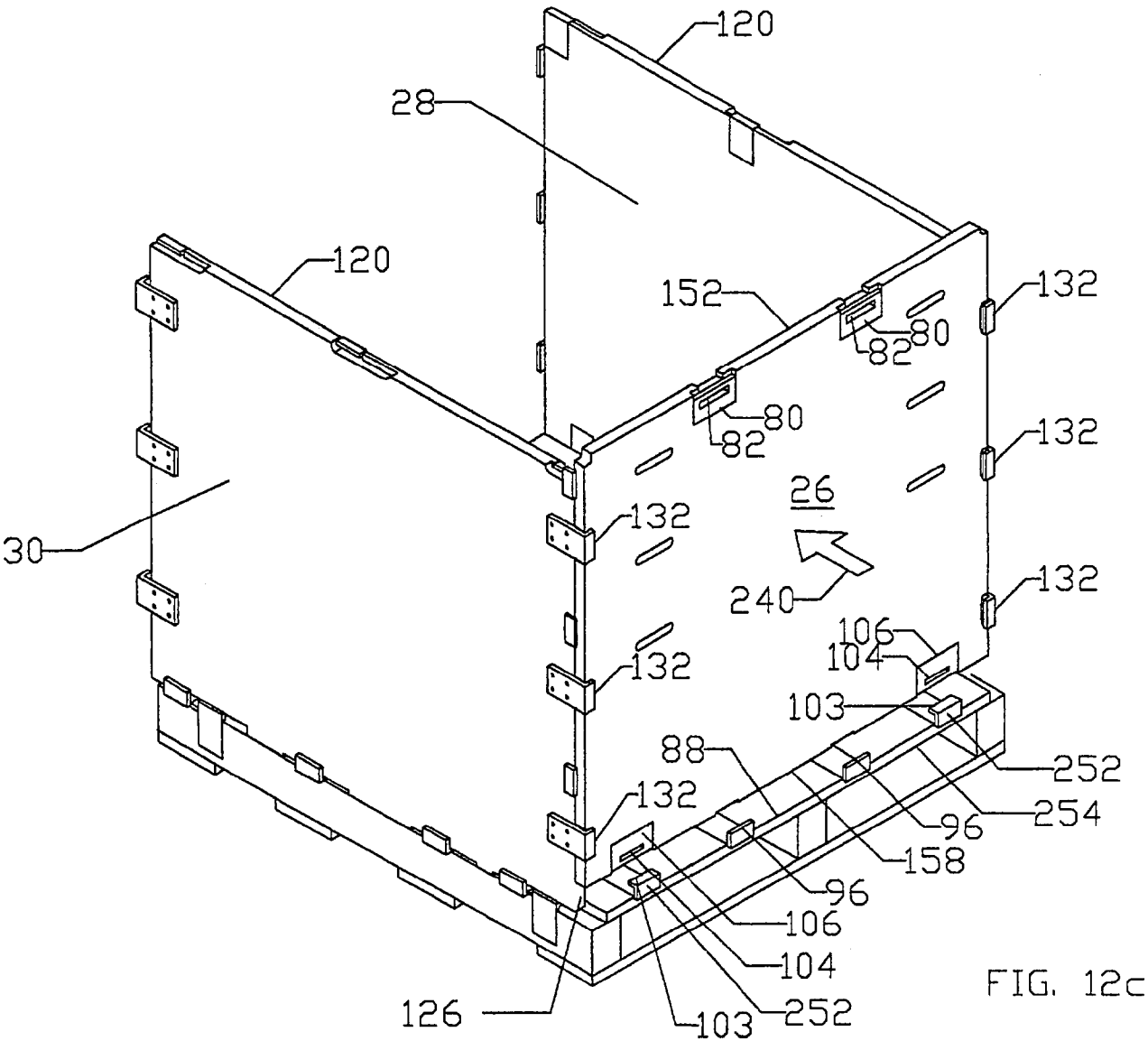
FIG. 12*c* is a perspective view of the left side, right side and rear side walls and base of the container.
Figure 12D:
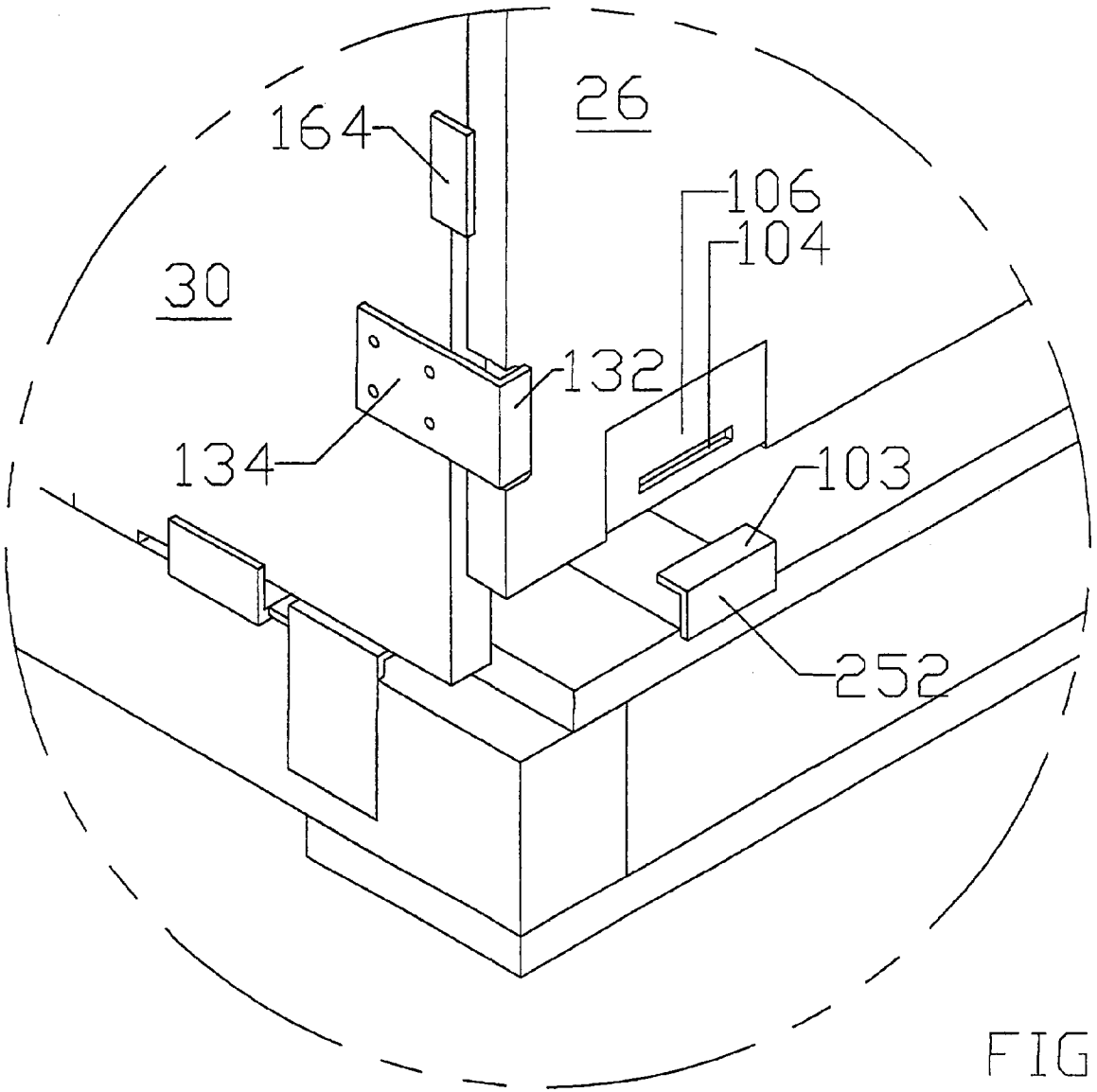
FIG. 12*d* is a detailed view of FIG. 12*c;*
Figure 12E:
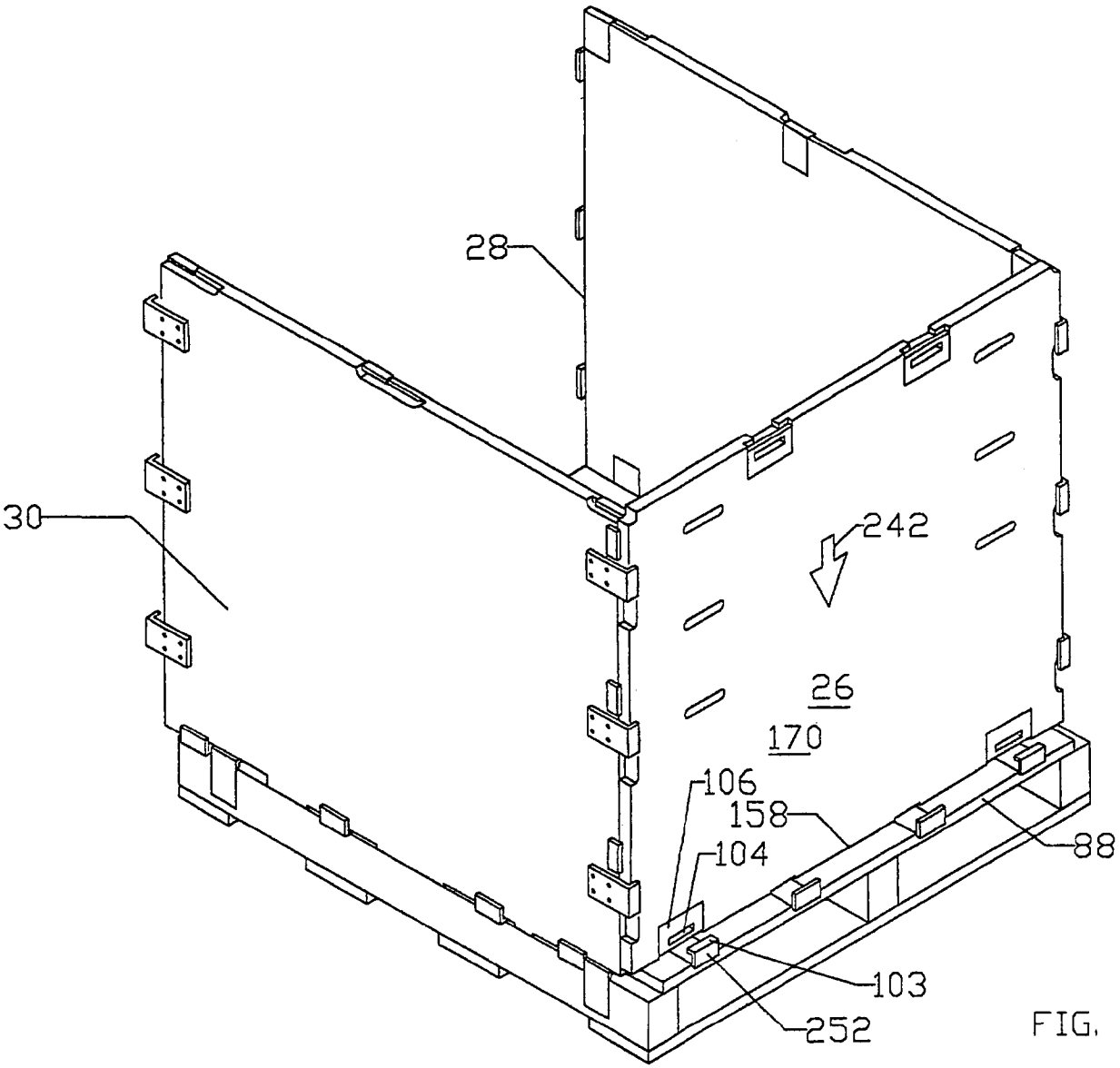
FIG. 12*e* is a perspective view of the left side, right side and rear walls and base of the container.
Figure 12F:
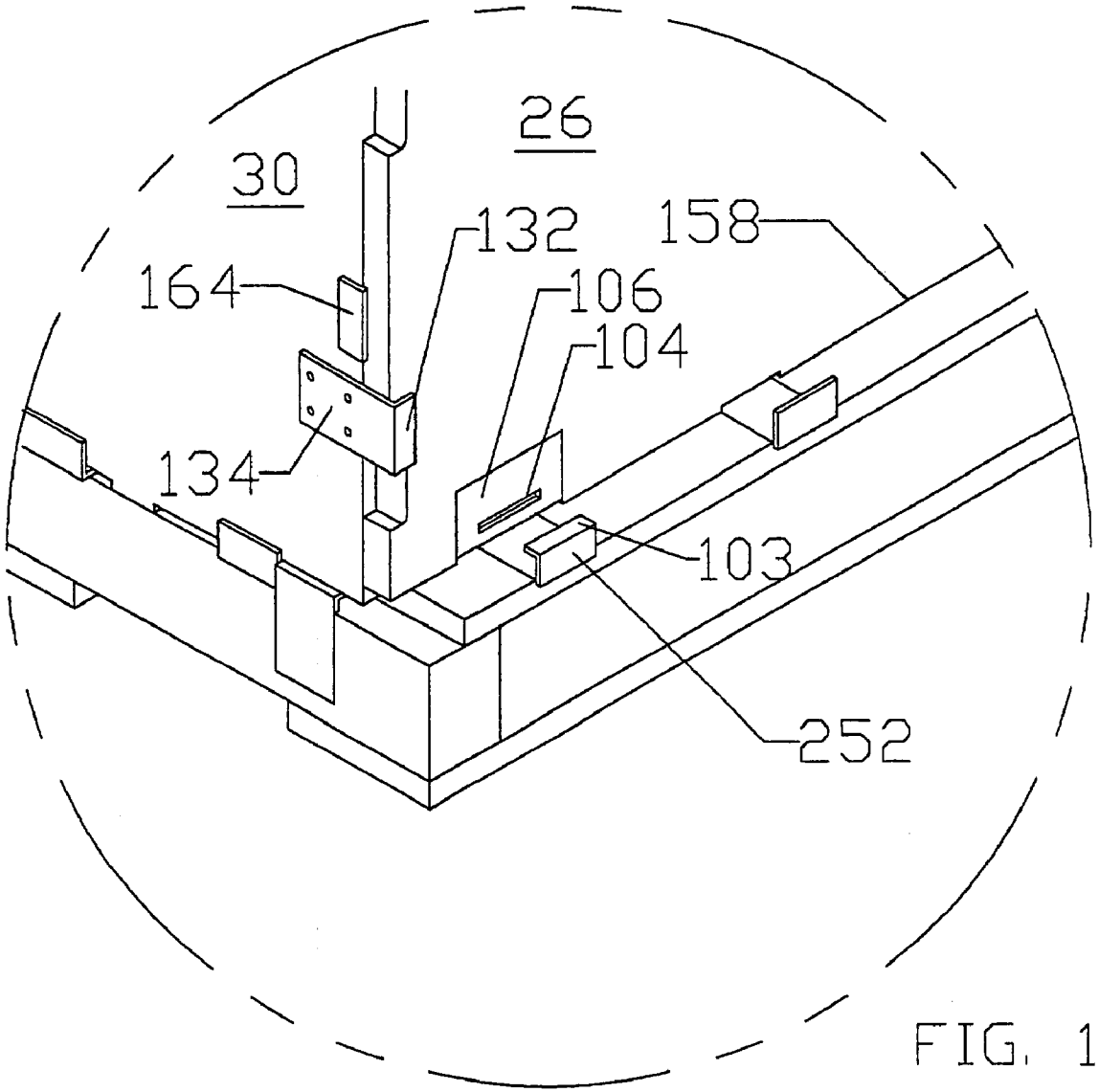
FIG. 12*f* is a detailed view of FIG. 12*d;*

Referring to FIG. 12*a*, wall 30 is shown in position connected to base 88 and supported in an upright position. As depicted in FIG. 12*a* walls 28 and 30 are positioned in a forward position to enable sufficient room for back wall 26 to be positioned against rear edges 126 and resting on base 88 without interfering with extensions 103. Back wall 26 is aligned with rear edges 126 in the direction of arrow 240 in a position where upper edge 152 is slightly higher than upper edges 120 to enable extensions 132 to pass through corresponding indented regions 166 so that back wall 26 is positioned against rear edges 126, as depicted in FIG. 12*c*. Extensions 132 are positioned from edges 126 a distance slightly greater than the width of wall 26. Referring to FIGS. 12*e* and 12*f*, wall 26 may then be lowered in the direction of arrow 242 until lower edge 158 rests on base 88. Upper edge 152 is then positioned the same as upper edges 120. Extensions 103 are then aligned with slots 104, although extensions 103 are not yet positioned within slots 104. Extensions 132 contact outer face 170 of wall 26 to connect walls 28 and 30 to wall 26.

Figure 12G:
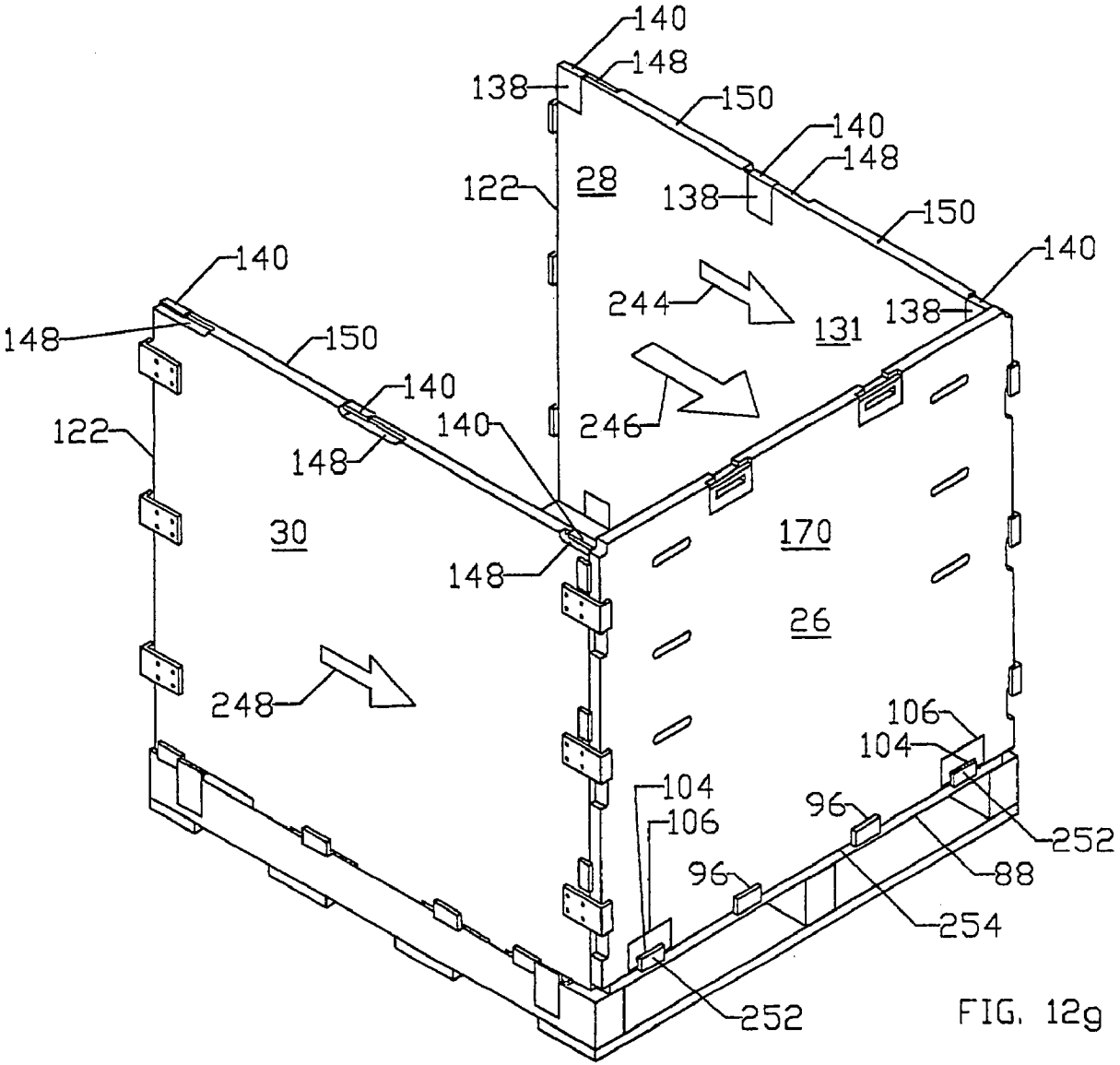
FIG. 12*g* is a perspective view of the left side, right side and rear walls and base of the container.
Figure 12H:
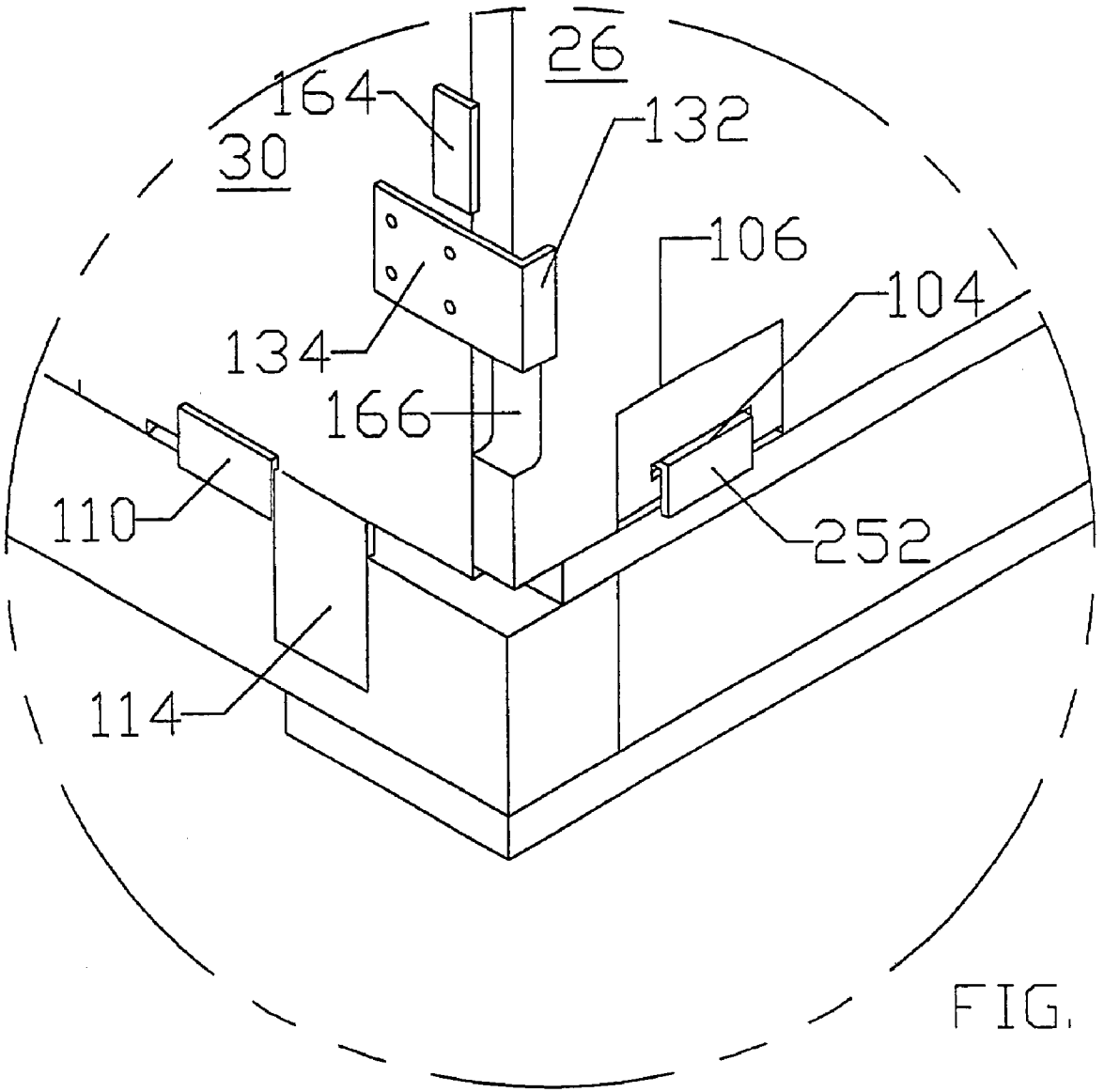
FIG. 12*h* is a detailed view of FIG. 12*f;*

Referring to FIG. 12*g*, wall 26 is then moved in the direction of arrow 244, wall 30 is moved in the direction of arrow 248 and wall 26 is moved in the direction arrow 246. This causes extension 103 to enter slot 104 until engagement member 106 contacts the inner face of extension connector 252. Face 170 is then generally in coplanar alignment with rear edge 254 of base 88. Face 170 is also contacted by extensions 96 to prevent further movement of wall 26 in the direction of arrow 246 and to support wall 26 on base 88.

Figure 13A:
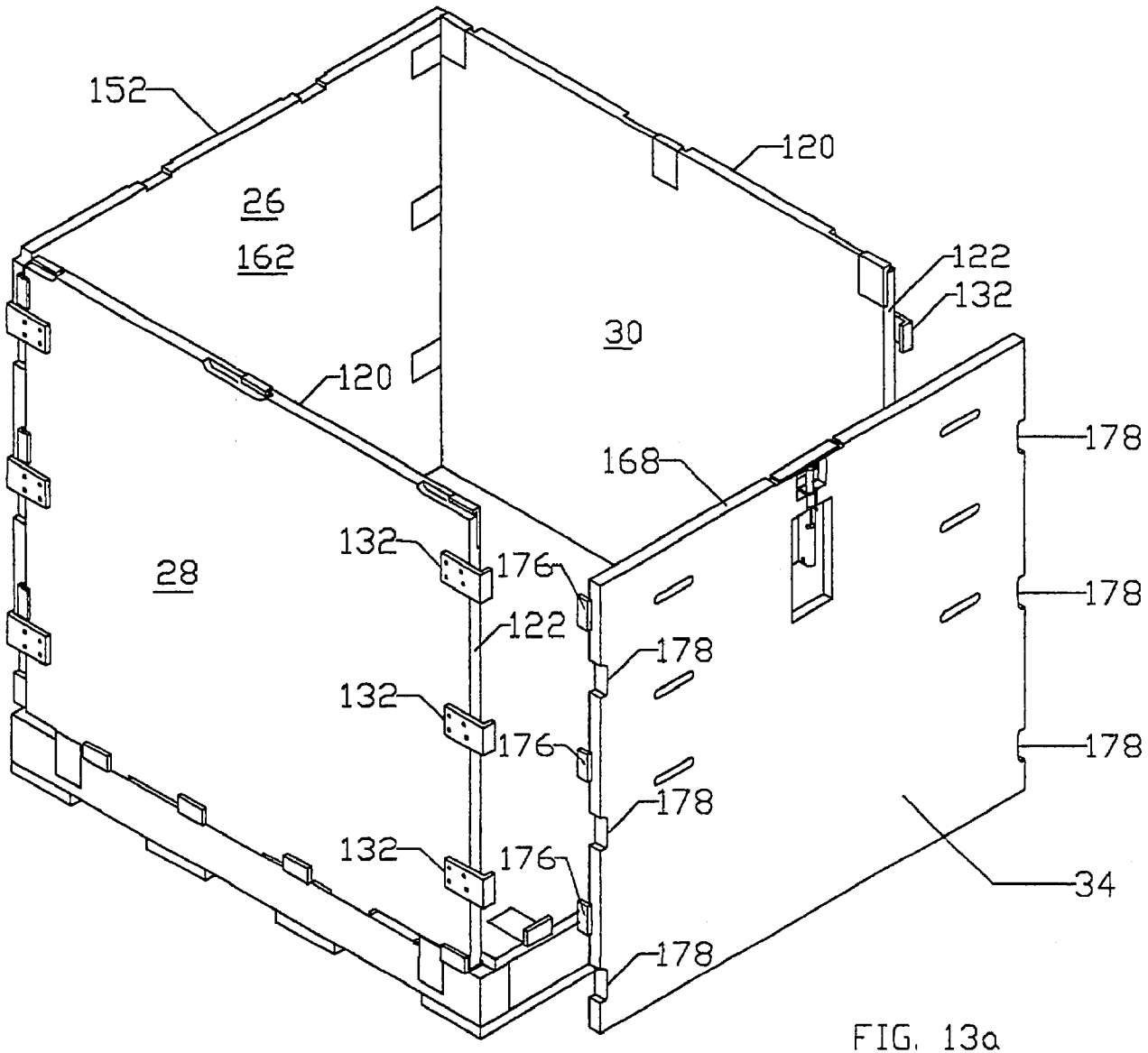
FIG. 13*a* is a perspective view of the left side, right side and rear side walls and front wall and base of the container.
Figure 13B:
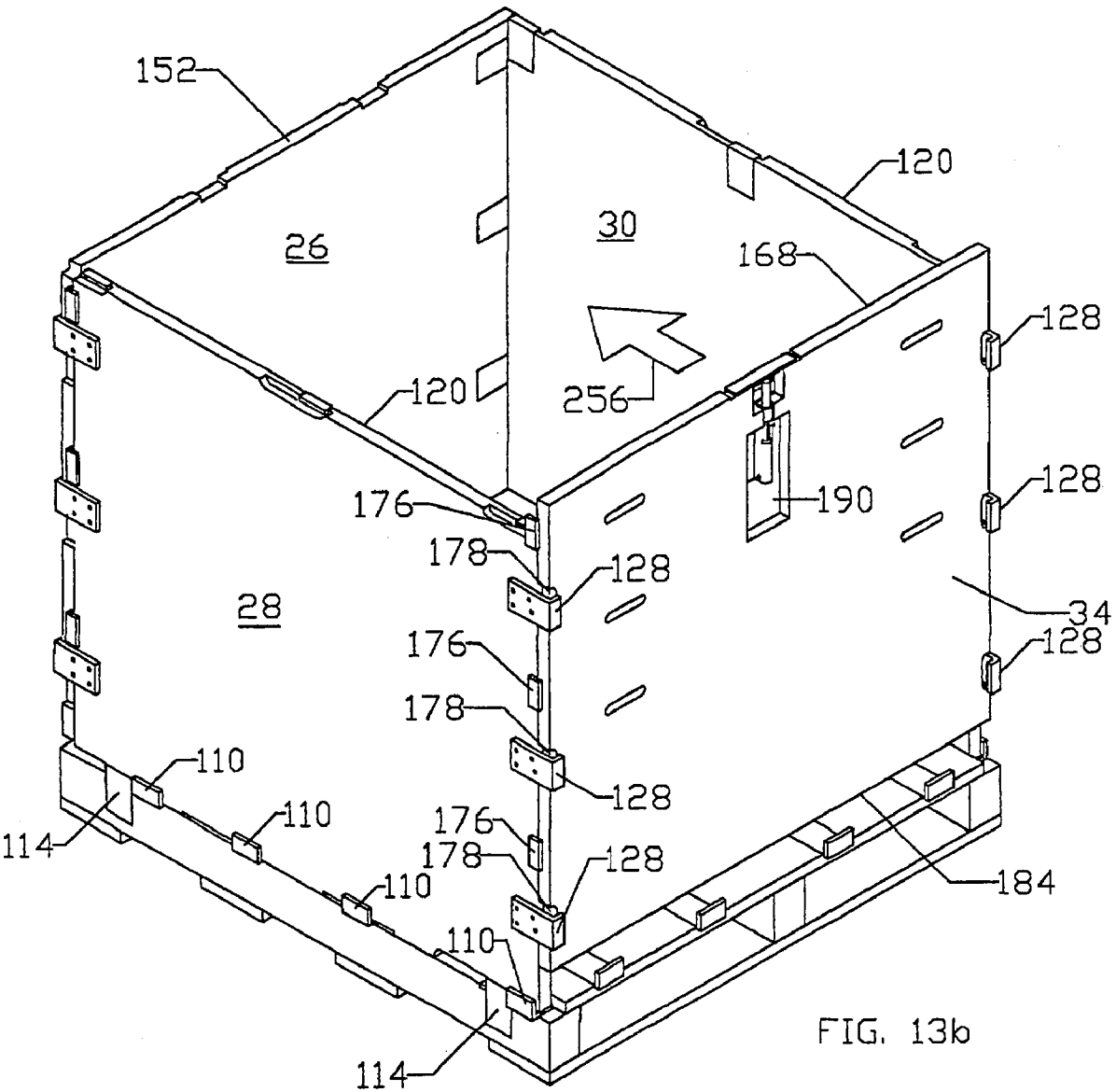
FIG. 13*b* is a perspective view of the left side, right side and rear side walls and front wall and base of the container.

Referring to FIGS. 13*a* and 13*b*, front wall 34 is positioned against front edges 122 of walls 28 and 30 by aligning wall 34 so that extensions 132 pass through indented regions 178 and moving wall 34 in the direction of arrow 256. Wall 34 is positioned with securing member 190 facing outwardly. Upper edge 168 is thereby positioned above upper edges 120 in a manner similar to that of back wall 26.

Referring to FIG. 13*c*, wall 34 may then be lowered in the direction of arrow 258 until lower edge 184 rests on base 88 supported adjacent edge 184 by extensions 96 of support members 92. Extensions 132 contact outer face 250 of wall 34 to secure wall 34 against edges 122. When in the position depicted in FIG. 13*c*, upper edges 152, side edges 120 and front edge 168 are in coplanar alignment.

Referring to FIG. 14*a*, lid 32 is then positioned above walls 26, 28, 30 and 34. Lid 32 is positioned such that extension section 66 is positioned adjacent front wall 34 and lid rear engagement members 54 are positioned adjacent back wall 26.

Referring to FIG. 14*d*, lid 32 is lowered in the direction of arrow 262 into the second position until it rests on edges 120 of walls 28 and 30 and edge 152 of wall 26 in an offset manner with an opening 264 into cavity 36 adjacent front wall 34. Reinforcement members 42 are positioned within cavity 36 (see FIG. 1) and extension sections 74 are positioned adjacent to outer face 170 of wall 26. In this offset or second position extension members 74 are positioned within scalloped portion 148 to permit lid 32 to rest on edges 120 and 152. Note, as depicted in FIG. 6, that the ends of the upper edge 152 are indented at indented region 260 which provides clearance for extension sections 74 to be moved over wall 26 if necessary to properly position rear reinforcement member 42 against inner face 162 of wall 26 (FIG. 13*a*). As well, in that offset position extension members 74 adjacent left and right edges 44 and 46 are positioned within scalloped portions 148 of edges 120.

Referring to FIGS. 14*g* through 14*m*, lid 32 is then moved in the direction of arrow 56 to its first position, that is until front edge 50 overlies upper edge 168 in coplanar alignment with face 174. This movement causes extension sections 74 adjacent rear edge 48 to move into slots 82 and also extension members 74 on left and right edges 44 and 46 to engage lateral extensions 140 as depicted in FIG. 14*i*. Movement of lid 32 in the direction of arrow 56 also moves extension section 66 into slot 227 with opening 68 in alignment with bolt 208. This is depicted in greater detail in FIGS. 9*a*, 9*b* and 14*j*. Members 80 include indented regions 171 which facilitate movement of securing sections 70 past top edge 152 on movement of lid 32 in the direction of arrow 56 (FIG. 14*g*) to the first position.

Referring to FIGS. 9 and 9*b*, bolt 208 is moved upwardly through opening 68 and bolt 208 rotated so that lateral extension 210 rests on slotted guide 206, as depicted in FIG. 9*a* to secure bolt 208 in opening 68 in its secured position. If it is desired to lock lid 32 in place, locking mechanism 224 of lock 222 may be extended through opening 221 below bottom 220. This locks lid 32 to walls 26, 28, 30 and 34.

Wall 34 is rigidly secured to lid 32 by means of bolt 208 through hole 68 preventing movement of lid 32 in a direction opposite to that of arrow 56. Upward movement of lid 32 in the first direction (that is opposite to the direction of arrow 262 of FIG. 14*d*) is also prevented by extension section 66 contacting flange contact surface 228 (FIGS. 9*a*, 9*b* and 10). Lid 32 is secured to sides 28 and 30 by extension 140 secured against extension 74 as depicted in FIG. 14*i*. Lid 32 is rigidly secured to back wall 26 by means of extension sections 74 adjacent rear edge 48 extending into slots 82. As well, as discussed above, base 88 is rigidly attached to walls 26, 28, 30 and 34. Walls 28 and 30 are attached to base 88 by means of extensions 116 contacting extensions 142. Wall 26 is connected to base 88 by means of extensions 103 extending into slots 104. Front wall 34 is connected to base 88, and upward movement of wall 34 prevented by lid 32 being rigidly secured to edges 120, 152 and 168 and as walls 26, 28 and 30 are rigidly connected to base 88.

In order to disassemble container 22, the above steps are repeated in reverse order.

What is claimed is:

1. A collapsible container comprising:

(a) a lid comprising:

(i) a pair of side edges connected to rear and front edges;

(ii) a flange connected to the lid adjacent the front edge, the flange extending in a plane parallel with a lid plane defined by the lid, the flange including an opening therein;

(b) a box comprising:

(i) a front wall and a plurality of side walls which when joined together form an assembled box with a cavity between the walls;

(ii) a channel in a first region of the front wall having a flange contact surface;

(iii) a bolt moveable in a direction perpendicular to the lid plane between a securing position and a non-securing position; and (iv) when the lid is positioned in a first position adjacent the walls covering the cavity with the flange positioned in the channel, the bolt may be moved to the securing position by positioning the bolt in the opening to restrict movement of the lid in a direction parallel to the lid plane whereby the flange engages the flange contact surface upon pressure on the lid in a first direction away from the cavity to restrict movement of the lid in the first direction;

(c) A plurality of lid securing members releasably securing the side and rear edges to adjacent side walls.

2. The container of claim 1 wherein the flange comprises a connection portion for connecting the flange to the lid attached to an extension portion extending in a plane parallel with the lid plane, the extension portion includes the opening therein, the extension portion extends into the channel when the lid is positioned adjacent the walls in alignment with the bolt to enable the bolt to extend through the opening when the bold is in the securing position.

3. The container of claim 2 wherein a lateral joining portion extends between the connection portion and extension portion to join those portions together, the joining portions extending generally perpendicular to the lid plane thereby positioning the extension portion in spaced paralleled alignment with the lid plane.

4. The container described in claim 3 wherein the front wall further comprises a reinforcement section positioned between the top edge of the front wall and the channel and wherein the flange contact surface is connected to the reinforcement section.

5. The container of claim 1 wherein the lid further comprises a stop positioned to align the lid with respect to the box in the first position and to align the opening with the longitudinal axis of the bolt to permit the bolt to be moved into the opening when the bolt is moved to the securing position.

6. The container as described in claim 5 wherein one or more lid securing members include the stop integral therewith.

7. The container as described in claim 5 wherein the stop contacts the side wall located opposite the cavity to the front wall to align the lid in the first position.

8. The containers as described in claim 1 wherein the plurality of lid securing members comprise lid alignment means to align the side edges of the lid with the top of the side walls of the box.

9. The container of claim 1 further comprising a base member extending about the bottom of the walls at the bottom of the cavity.

10. The container of claim 8 wherein the base member comprises a pallet.

11. The container as described in claim 8 further comprising base securing members releasably securing the base member to the side walls and the front wall.

12. The container as described in claim 9 further comprising base securing members releasably securing the base member to the side walls and the front wall.

13. The container as described in claim 1 wherein the bolt has a first end which engages the flange contact surface when the bolt is in the securing position.

14. The container of claim 1 wherein the bolt further comprises a bolt securing lever which releasably secures the bolt in the securing position.

15. The container of claim 14 wherein the bolt further comprises a lock which locks the bolt in the securing position.

16. The container as described in claim 1 wherein the lid further comprises reinforcement members along its side edges and along its rear and front edges.

17. The container as described in claim 16 wherein the reinforcement members on the side edges align the side edges with corresponding side walls of the box when the lid is positioned adjacent both side walls.

18. The container as described in claim 1 wherein the front wall further comprises a cavity dimension to accept the bolt therein such that the bolt is completely contained within the cavity without protruding beyond the outer face of the front wall.

19. The container as described in claim 1 wherein the number of side walls is 3 and which when jointed together with a front wall form a square or rectangular assembled box.

20. The container as described in claim 1 wherein the bolt is moved toward the lid to move the bolt into the securing position and away from the lid to move the bolt in the non-securing position, when the lid is positioned in its first position.

21. The container as described in claim 1 wherein the plurality of lid securing members comprise a plurality of lid contact members connected to side edges and rear edges of the lid and a plurality of box securing members connected to the plurality of side walls and wherein the lid contact members and box securing members are engaged with one another when the lid is in the first position and not engaged with one another when the lid is in a second position.

22. The container as described in claim 21 wherein the lid is moveable with respect to the box in the direction of the lid plane toward the front edge to move between a second position where the lid may be separated from the box and the first position wherein the lid securing members secure the siding rear edges to adjacent side walls and the flange is positioned in the channel.

23. The container as described in claim 1 wherein the channel is longitudinally shaped with a longitudinal axis parallel with the lid plane and wherein the flange comprises a longitudinal channel contact surface for engaging the flange contact surface upon pressure on the lid in the first direction.

24. The container as described in claim 1 wherein the lid is moveable with respect to the box in the direction of the lid plane between a second position in which the bolt and the flange opening are not in alignment and the lid securing members are not engaged with one another and the first position in which the flange extends into the channel, the flange opening is aligned with the bolt and the lid securing members are engaged with one another.

25. The container as described in claim 1 wherein when the lid is in the second position the lid is removable from the box.

26. The container as described in claim 23 wherein when the lid is in the first position and the bolt is moved to its secured position in the flange opening the lid is prevented from movement from the first position and the first and second engagement members prevent movement of the lid in the first direction away from the edges.

27. The container as described in claim 1 wherein the front wall further comprises a reinforcement plate adjacent the bolt.

28. The container as described in claim 27 wherein the reinforcement plate includes a plate channel aligned with the channel and dimensioned to receive the flange therein.

29. The container as described in claim 28 wherein the flange plate further comprises the flange contact surface.

30. The container as described in claim 29 wherein the reinforcing plate comprises a relatively larger bolt supporting portion positioned to reinforce the bolt and the region adjacent the bolt and a flange contact surface supporting portion positioned to reinforce the flange contact surface.

* * * * *